US005666140A

United States Patent [19]

Mitani et al.

[11] Patent Number: 5,666,140

[45] Date of Patent: Sep. 9, 1997

[54] INK JET PRINT HEAD

[75] Inventors: Masao Mitani; Kenji Yamada; Osamu Machida, all of Katsuta, Japan

[73] Assignee: Hitachi Koki Co., Ltd., Tokyo, Japan

[21] Appl. No.: 228,897

[22] Filed: Apr. 18, 1994

[30] Foreign Application Priority Data

| | | | |
|---|---|---|---|
| Apr. 16, 1993 | [JP] | Japan | 5-090123 |
| Sep. 17, 1993 | [JP] | Japan | 5-231913 |
| Dec. 17, 1993 | [JP] | Japan | 5-318272 |

[51] Int. Cl.[6] ..... B41J 2/05; B41J 2/14

[52] U.S. Cl. ..... 347/12; 347/40; 347/59; 347/62

[58] Field of Search ..... 347/59, 12, 13, 347/62, 40

[56] References Cited

U.S. PATENT DOCUMENTS

| | | | |
|---|---|---|---|
| 4,335,389 | 6/1982 | Shirato et al. | 347/64 |
| 4,353,079 | 10/1982 | Kawanabe | 347/12 |
| 4,364,067 | 12/1982 | Koto | 347/40 |
| 4,517,444 | 5/1985 | Kawahito et al. | 219/216 |
| 4,772,520 | 9/1988 | Takeno et al. | 428/698 |
| 4,908,638 | 3/1990 | Albosta | 347/43 |
| 4,914,562 | 4/1990 | Abe | 347/63 |
| 4,947,192 | 8/1990 | Hawkins et al. | 347/59 |
| 5,045,870 | 9/1991 | Lamey | 347/59 |
| 5,113,203 | 5/1992 | Takagi et al. | 347/62 |
| 5,122,814 | 6/1992 | Endo | 347/57 X |
| 5,206,659 | 4/1993 | Sakurai et al. | 347/62 |
| 5,214,450 | 5/1993 | Shimoda | 347/57 X |
| 5,239,312 | 8/1993 | Merna et al. | 347/41 |
| 5,287,123 | 2/1994 | Medin | 347/102 X |

FOREIGN PATENT DOCUMENTS

| | | | |
|---|---|---|---|
| 48-9622 | 2/1973 | Japan . | |
| 54-51837 | 4/1979 | Japan | B41J 3/04 |
| 55-109672 | 8/1980 | Japan | B41J 3/04 |
| 62-167056 | 7/1987 | Japan . | |
| 4-166966 | 6/1992 | Japan | G03G 15/20 |
| 5-507037 | 10/1993 | Japan | B41J 2/16 |
| 91/17051 | 11/1991 | WIPO | B41J 2/16 |

OTHER PUBLICATIONS

Nikkei Mechanical, Dec. 28, 1972, pp. 58–63.

J. Baker et al., "Design and Development of a Color Thermal Inkjet Print Cartridge," Hewlett–Packard Journal, Aug. 1988.

*Primary Examiner*—Joseph W. Hartary

*Attorney, Agent, or Firm*—Whitham, Curtis, Whitham & McGinn

[57] ABSTRACT

An ink jet print head includes: a monolithic silicon substrate having a top surface; a plurality of chamber walls for defining a plurality of ink chambers on the top surface of the silicon substrate, the plurality of ink chambers being aligned in a first direction into a row extending along the top surface of the silicon substrate, each of the plurality of ink chambers being filled with ink, each chamber wall having a nozzle portion for defining a nozzle of a plurality of nozzles, each nozzle portion being formed so that each nozzle is in fluid communication with a respective ink chamber, the plurality of nozzles being aligned in the first direction into a row extending parallel to the top surface of the silicon substrate; an integrated circuit provided on the top surface of the silicon substrate and located adjacent to the plurality of ink chambers for outputting pulsed electric current; and a plurality of thermal resistors provided on the top surface of the silicon substrate each being located in a corresponding ink chamber of the plurality of ink chambers, each of the plurality of thermal resistors including a thin-film resistor. the thin-film resistor being made of a material selected from a group consisting of Ta—Si—SiO alloy and Cr—Si—SiO alloy, the thin-film conductor being made of a material selected from a group consisting of tungsten and nickel.

20 Claims, 7 Drawing Sheets

FIG. 4
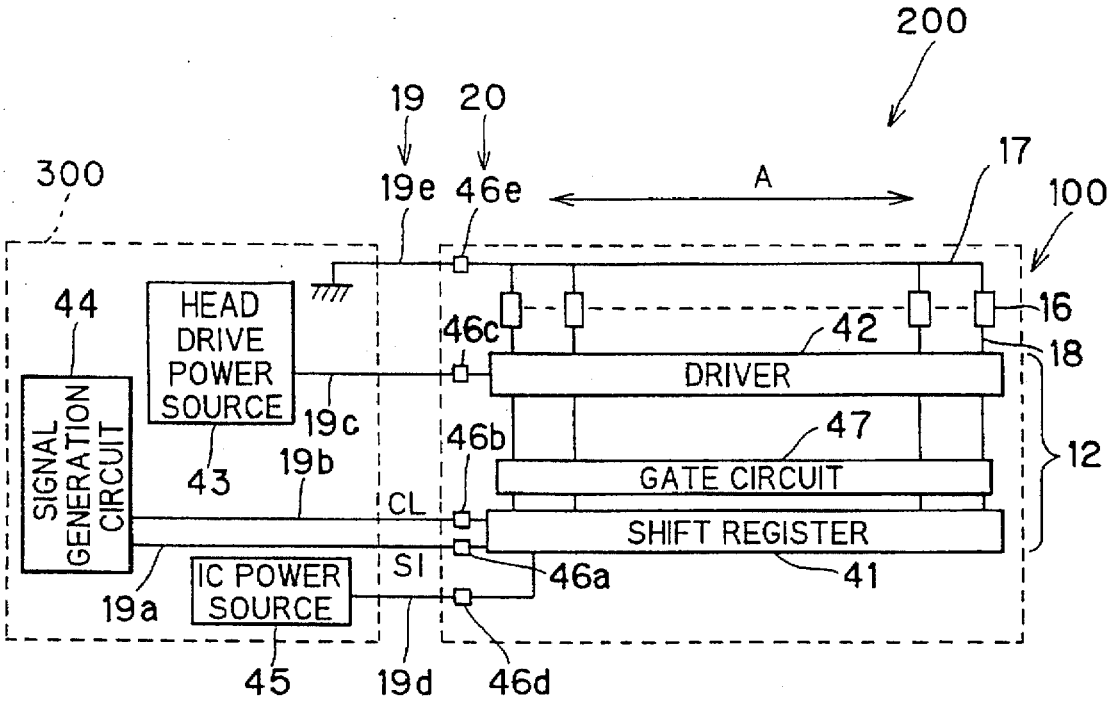
CL : CLOCK SIGNAL
SI : PRINT DATA AI,J
FIG. 5(a)
FIG. 5(b)
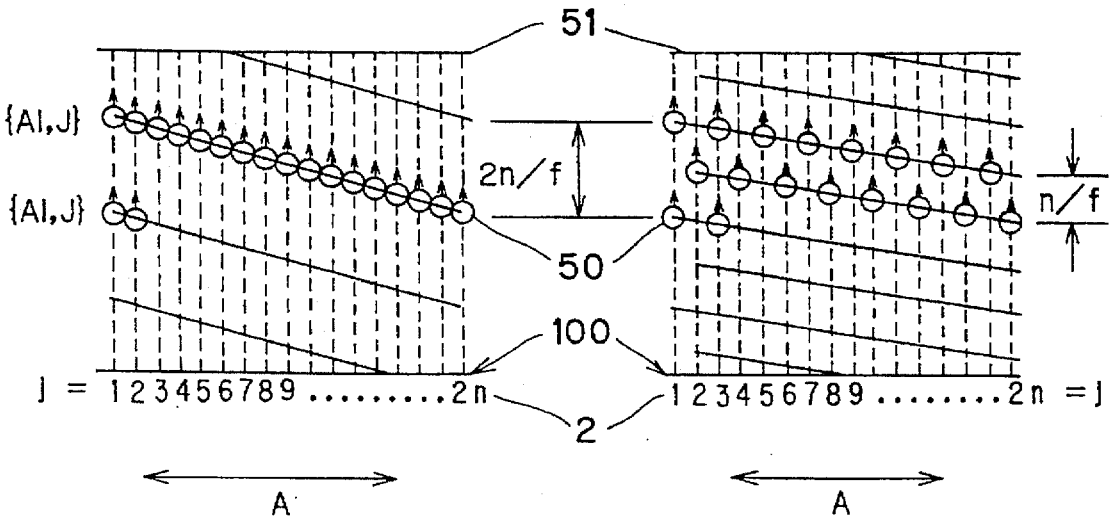

INK JET PRINT HEAD

BACKGROUND OF THE INVENTION

1. Field of the Invention

The present invention relates to an ink jet printer head for a printer and more particularly to the ink jet print head using thermal energy to eject ink droplets from a plurality of nozzles so that the ink droplets impinge on a print sheet.

2. Description of the Related Art

Thermal-pulse ink jet printers have been described in, among other sources, Japanese Patent Application Kokai Nos. SHO-48-9622 and SHO-54-51837. In one type of thermal-pulse ink jet printer, a print head provided thereto includes a plurality of ink droplet generators. Each ink droplet generator includes an ink chamber filled with ink, a thermal resistor formed to the wall of the ink chamber, and a nozzle formed in the wall of the ink chamber. The nozzle fluidly connects the ink chamber with the atmosphere. Pulses of voltage are selectively applied to the thermal resistors of the plurality of ink droplet generators so that an energized thermal resistor generates a pulse of heat. The pulse of heat generated at an energized thermal resistor rapidly vaporizes a small amount of the ink filling the ink chamber. The force produced by the expansion of the resultant vapor bubble ejects an ink droplet from the corresponding nozzle. The vapor bubble then collapses and disappears.

Concrete examples of thermal resistors for use in thermal-pulse ink jet printers have been described in a presentation made at the Feb. 26, 1992 convention for High Technology for Hard Copy sponsored by the Japan Technology Transfer Association, on page 58 of the Dec. 28, 1992 edition of Nikkei Mechanical and in the August 1988 edition of Hewlett-Packard-Journal. As is shown in FIG. 1, a typical thermal resistor used in a print head of a thermal-pulse ink jet printer includes a thin-film resistor 443 and a thin film conductor 444, both covered with an anti-oxidation layer 445. An anti-cavitation layer 446 is formed over a heating area of the anti-oxidation layer 445 for preventing cavitation of the anti-oxidation layer 445. An additional anti-cavitation layer 447 can also be provided.

Copending U.S. patent application Ser. No. 068,348 (not prior art) describes a thermal resistor formed from a Cr—Si—SiO or Ta—Si—SiO alloy thin-film resistor and a nickel thin-film conductor. The excellent anti-pulse, anti-oxidation, anti-cavitation, and anti-corrosion properties of these materials allows forming the thermal resistor without the anti-oxidation layer or the anti-cavitation layers. Because the ink comes into direct contact with this thermal resistor, the pulse of heat produced thereby is transferred to the ink with 30 to 60 time greater efficiency. Vaporization and ejection of ink is therefore greatly improved.

Another copending U.S. patent application Ser. No. 172,825 (not prior art) describes an on-demand type print head incorporating the above-described protection-layerless thermal resistors. Because transfer of heat is so efficient when using the protection-layerless thermal resistors, vapor bubbles can be generated by applying only a small voltage to the thermal resistors. Therefore, the area around the thermal resistors remains cool enough to allow forming a print head that includes a large-scale integrated circuit, for driving the print head, adjacent to the thermal resistors.

In order to allow printing over the entire surface of a sheet to be printed on, ink jet printers usually are provided with a carriage for supporting the print head and a platen roller for supporting the sheet adjacent to the print head. The carriage is provided to a slider so as to be returnably scanningly movable in a main scanning direction. The platen roller is provided so as to be capable of step feeding the sheet supported therein in an auxiliary scanning direction perpendicular to the main scanning direction. Because the print head can be scanned widthwise across the surface of the sheet in the main scanning direction and because the sheet can be step fed in the auxiliary direction, the entire surface of the sheet can be printed on.

It has been desired to produce a print head with a length equal to the width of the sheet to be printed on. With such a long print head, termed a line head, an entire line of a sheet could be printed without scanning the head across the sheet. Printing could be performed faster and without a complicated drive being required for synchronizing the main scanning operation with the auxiliary scanning operation.

SUMMARY OF THE INVENTION

It is therefore an object of the present invention to provide a print head which has a simple structure and therefore which can have a large number of nozzles to thereby attain a high print speed.

In order to attain the object, the present invention provides an ink jet print head, for ejecting ink droplets, comprising: a monolithic silicon substrate having a top surface; a plurality of chamber walls for defining a plurality of ink chambers on the top surface of the silicon substrate, the plurality of ink chambers being aligned in a first direction into a row extending along the top surface of the silicon substrate, each of the plurality of ink chambers being filled with ink, each chamber wall having a nozzle portion for defining a nozzle of a plurality of nozzles, each nozzle portion being formed so that each nozzle is in fluid communication with a respective ink chamber, the plurality of nozzles being aligned in the first direction into a row extending parallel to the top surface of the silicon substrate; an integrated circuit provided on the top surface of the silicon substrate and located adjacent to the plurality of ink chambers for outputting pulsed electric current; and a plurality of thermal resistors provided on the top surface of the silicon substrate each being located in a corresponding ink chamber of the plurality of ink chambers, each of the plurality of thermal resistors including a thin-film conductor connected to the integrated circuit for receiving the pulsed electric current from the integrated circuit and a thin-film resistor connected to the thin-film conductor for receiving the pulsed electric current from the thin-film conductor and for generating pulsed heat in response to the pulsed electric current, the thin-film resistor having a surface portion exposed to the ink contained in the corresponding ink chamber for directly heating the ink with the generated pulsed heat so as to eject an ink droplet from the corresponding ink chamber through the nozzle, the thin-film resistor being made of a material selected from a group consisting of Ta—Si—SiO alloy and Cr—Si—SiO alloy, the thin-film conductor being made of a material Selected from a group consisting of tungsten and nickel.

According to another aspect, the present invention provides an ink jet printer, for ejecting ink droplets onto a sheet to thereby form a desired ink image on the sheet, comprising: an ink jet print head for ejecting ink droplets, the ink jet print head including a mounting frame formed with an ink supply channel and a monolithic ink ejection section mounted on the mounting frame, the monolithic ejection section including: a single silicon substrate having a top surface and an under surface opposed to each other, the silicon substrate being mounted on the mounting frame with its under surface contacted with the mounting frame, the silicon substrate being formed with a common ink channel extending in a first direction along the top surface and a plurality of connection channels extending from the common ink channel to the under surface, the plurality of connection channels being communicated with the ink supply channel of the mounting frame, the plurality of connection channels being arranged in the first direction with a gap being formed therebetween; a partition member mounted on the top surface of the silicon substrate for defining a row of a plurality of ink chambers on the top surface of the silicon substrate, the row of the plurality of ink chambers being arranged in the first direction along the top surface of the silicon substrate, each of the plurality of ink chambers being filled with ink; a nozzle plate mounted on the partition member for defining a row of a plurality of nozzles in fluid communication with the row of the plurality of ink chambers, the row of the plurality of nozzles extending in the first direction; an integrated circuit provided on the top surface of the silicon substrate for outputting pulsed electric current; and a plurality of thermal resistors provided on the top surface of the silicon substrate each being located in a corresponding one of the plurality of ink chambers, each of the plurality of thermal resistors including a thin-film conductor connected to the integrated circuit for receiving the pulsed electric current from the integrated circuit and a thin-film resistor connected to the thin-film conductor for receiving the pulsed electric current from the thin-film conductor and for generating pulsed heat, the thin-film resistor having a surface portion exposed to the ink contained in the corresponding ink chamber for directly heating the ink with the generated pulsed heat so as to eject a droplet of ink from the ink chamber through the nozzle, the thin-film resistor being made of material selected from a group consisting of Ta—Si—SiO alloy and Cr—Si—SiO alloy, the thin-film conductor being made of material selected from a group consisting of tungsten and nickel; and a relative movement attaining means for supporting a sheet having a width extending in the first direction and for attaining relative movement between the sheet and the ink jet print head in a second direction substantially perpendicularly to the first direction.

According to a further aspect, the present invention provides an ink jet print head comprising: a first monolithic section having a length extending in a lengthwise direction and a width extending in a widthwise direction, the lengthwise direction being substantially perpendicular to the widthwise direction, the first monolithic section having a connection surface provided at a lengthwise tip thereof and a nozzle surface; a second monolithic section having a length extending in the lengthwise direction and a width extending in the widthwise direction, the second monolithic section having a connection surface provided at a lengthwise tip thereof and a nozzle surface, the connection surface of the first monolithic section being connected to the connection surface of the second monolithic section at a connected portion between the first monolithic section and the second monolithic section so that the nozzle surface of the first monolithic section and the nozzle surface of the second monolithic section are both aligned with a nozzle surface plane; a plurality of ink droplet generators for ejecting ink droplets, the plurality of ink droplet generators being formed in the first monolithic section and the second monolithic section so as to be aligned in the lengthwise direction, each ink droplet generator including an ink chamber wall defining an ink chamber, a thermal resistor formed on the ink chamber wall in the ink chamber, and a nozzle wall defining a nozzle, the nozzle wall being formed so that the nozzle has an axis angled toward the connection portion at an angle θ to a line perpendicular to the nozzle surface plane.

According to a further aspect, the present invention provides a printer comprising: a monolithic section of a print head, the monolithic section having an exposed surface; a plurality of ink droplet generators for ejecting ink droplets at a velocity in an ejection direction so that ejected ink droplets have an average length extending in the ejection direction, each ink droplet generator including an ink chamber wall defining an ink chamber, a thermal resistor formed on the ink chamber wall so as to be in the ink chamber, and a nozzle wall defining a nozzle, the nozzle wall being in connection with the chamber wall and the exposed surface, the plurality of ink droplet generators being formed in the monolithic section so that the nozzles of adjacent ink droplet generators of the plurality of ink droplet generators are aligned in an order along the exposed surface; a drive circuit for producing a serial drive signal for driving the plurality of ink droplet generators, the serial drive signal produced so as to cause pulses of voltage to be selectively applied to the thermal resistors of the ink droplet generators at a time phase between adjacent ink droplet generators so that the time phase is greater than a quotient of the average length of the ink droplets divided by the velocity of the ink droplets.

BRIEF DESCRIPTION OF THE DRAWINGS

The above and other objects, features and advantages of the invention will become more apparent from reading the following description of the preferred embodiment taken in connection with the accompanying drawings in which:

FIG. 4 is a block diagram showing circuitry of the print head shown in FIGS. 2 and 3 and a head drive circuit for driving the print head;

FIG. 5(*a*) is a top view showing a pattern formed by ink droplets ejected using the circuitry shown in FIG. 4;

FIG. 5(*b*) is a top view showing another pattern formed by ink droplets ejected using the circuitry shown in FIG. 4;

DETAILED DESCRIPTION OF THE PREFERRED EMBODIMENTS

Figure 1:
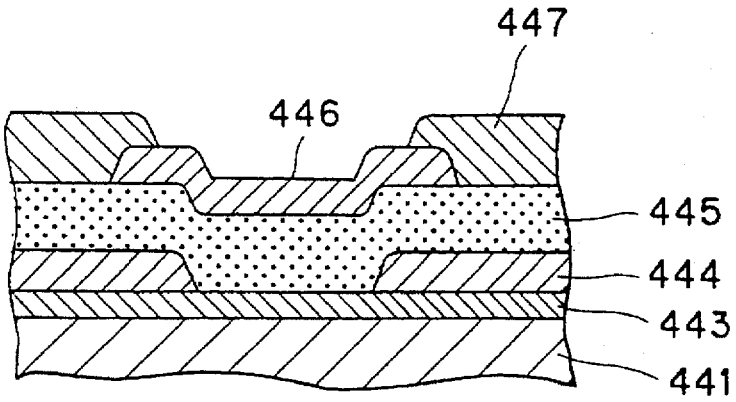
FIG. 1 is a cross-sectional view showing a conventional thermal resistor with protective layers.

An ink jet printer according to preferred embodiments of the present invention will be described while referring to the accompanying drawings wherein like parts and components are designated by the same reference numerals to avoid duplicating description.

An ink jet printer head according to a first preferred embodiment will be described in the following text while referring to FIGS. 2 through 10.

Figure 2:
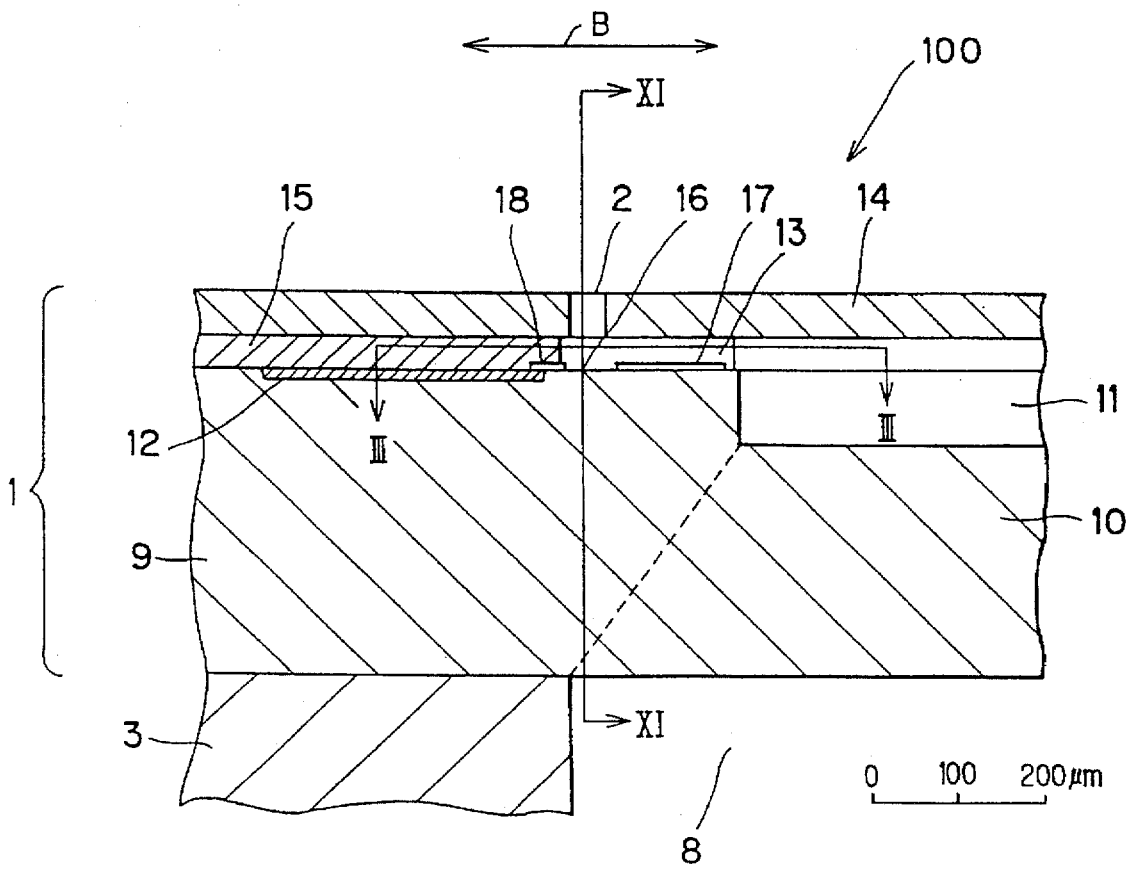
FIG. 2 is a cross-sectional view showing structure of a print head according to the present invention.
Figure 3:
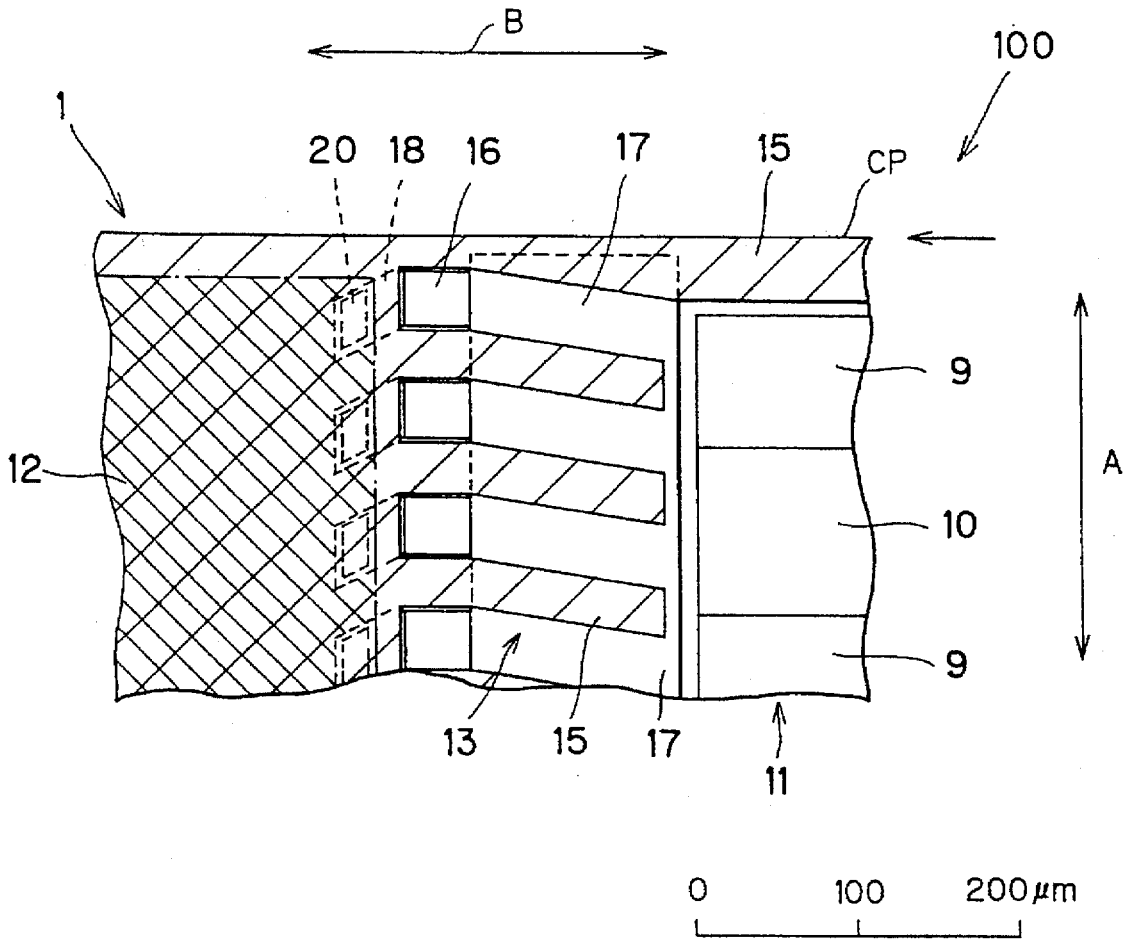
FIG. 3 is a cross-sectional view taken along a line III—III in FIG. 2.

As shown in FIGS. 2 and 3, the ink jet printer head 100 of the embodiment is constructed from a mounting frame 3 and a monolithic driving section 1 mounted thereon. The monolithic driving section 1 includes a silicon substrate or wafer 9 having a top side and an under side, the under side being attached to the mounting frame 3. The silicon substrate 9 is formed with a common ink channel 11, at its top side. The common ink channel 11 extends in a direction A indicated in FIG. 3 (which will be referred to as a "main scanning direction," hereinafter). The silicon substrate 9 is further formed with a plurality of connection channels 10 extending between a bottom surface of the common ink channel 11 and the under side of the silicon substrate 9. The connection channels 10 are formed in the substrate 9 intermittently along the main scanning direction A, as shown in FIG. 3. The mounting frame 3 is formed with a single ink supply channel 8 extending in the main scanning direction A and connected to the connection channels 10. The mounting frame 3 is provided with an ink supply port 6 (not shown) fluidly connected to the ink supply channel 8 for supplying ink thereto.

A partition member 15 is provided on the top side of the silicon substrate 9 so as to define a plurality of ink chambers 13 which are all connected to the common ink channel 11. The ink chambers 13 are .aligned in the main scanning direction A.

A thermal resistor 16 and a pair of conductors 17 and 18 connected to the thermal resistor 16 are provided in each of the ink chambers 13. The thermal resistor 16 and the conductors 17 and 18 are provided on the top side of the silicon substrate 9.

A cover member 14 provided over the partition member 15 is formed with a plurality of nozzles. 2, each of which is connected to a corresponding one of the plurality of ink chambers 13.

Each ink chamber 13 provided with the thermal resistor 16 and the conductors 17 and 18 and the nozzle 2 connected to the ink chamber 13 construct an ink droplet generator for ejecting an ink droplet from the nozzle 2. Accordingly, the print head 100 of the embodiment has a plurality of ink droplet generators arranged in the main scanning direction A.

With the above structure, ink supply pathway for supplying ink toward each of the ink droplet generator is constructed by the ink supply channel 8, the plural connection holes 10, and the common ink channel 11 which are fluidly connected with one another.

A single drive large scale integrated circuit (LSI circuit) 12 is formed on the top side of the silicon substrate 9, through a semiconductor process. The LSI circuit 12 is for driving the thermal resistors 16 in all the ink chambers 13. The thermal resistors 16 are connected to the drive LSI circuit 12 in such a manner that the corresponding individual conductors 18 are connected via through-hole connectors 20 to collector electrodes (not shown) provided in the drive LSI circuit 12.

The thermal resistor 16 and the conductors 17 and 18 are a Cr—Si—SiO alloy thin-film resistor and nickel thin-film conductors, respectively. Details of the Cr—Si—SiO alloy thin-film resistor and nickel thin-film conductors are described in the already-mentioned copending U.S. patent application No. 068,348, the disclosure of which is hereby incorporated by reference. For example, the thermal resistor 16 and the conductor lines 17 and 18 are formed to a thickness of 700 Å and 1 μm, respectively. The resistance of the thin-film resistor 16 is about 1,500 Ω. An approximately 1,500 Å thick $Ta_2O_5$ anti-etching layer (not shown) and an approximately 2 μm thick $SiO_2$ heat insulation layer (not shown) are provided under the thin-film resistor 16 and the conductors 17 and 18 on the top side of the silicon substrate 9.

Because the Cr—Si—SiO alloy resistor 16 and the nickel conductors 17 and 18 are not covered by any protection layers and therefore directly heat ink filling in the ink chamber 13, energy required to eject an ink droplet is reduced to about 1 μJ/droplet, that is, about 1/30th the energy required in conventional thermal resistors with protection layers. Copending U.S. patent application Ser. No. 068,348 describes tests which determined the life of this protection-layerless thermal resistor is one billion pulses or more regardless of whether the ink ejected is water based or oil based. This reduction in required energy allows positioning the thermal resistors adjacent to and on the same silicon substrate 9 as the drive LSI circuit 12 for driving the thermal resistors.

Copending U.S. patent application Ser. No.068,348 further describes that the protection-layerless thermal resistor used in the print head, i.e. formed from the Cr—Si—SiO alloy thin film resistor 16 and nickel conductors 17 and 18, efficiently heats ink in the ink chamber when applied with an extremely short, i.e., 1 μs or less, pulse of voltage. Accordingly, to eject an ink droplet, the drive LSI circuit 12 applies a short pulse, i.e., 1 μs or less, of voltage to the Cr-Si-Si alloy thermal resistor 16 according to a print signal. The thermal pulse generated by the thermal resistor 16 ejects an ink droplet from the nozzle 2. The ejected ink droplet impinges on a sheet 51 supported a distance of between 1 to 2 mm, for example, from the nozzle 2, thereby forming a dot on the sheet.

The following text is a concrete example of a method for forming the print head 100 shown in FIG. 2. First, the common ink channel 11 is photoetched into one side of a silicon wafer to a depth of approximately 150 μm using either a good inorganic resist (such as $SiO_2$ or $Si_3N_4$) or an organic resist (such as a polyimide). The connection ink holes 10 are then photoetched into the reverse side of the silicon wafer to form the side of the silicon substrate 9 which will confront the head mounting frame 3. The LSI drive circuit 12, thermal resistors 16, and conductors 18 and 17 are then formed on the substrate 9. A water-resistant cover material 15, such as a film resist or a polyimide with good water resistant properties, is adhered to the surface of the silicon wafer with the common ink channel 11 formed therein. The water-resistant cover material 15 is formed and positioned so as to cover the drive LSI device 12 and acts as a passivation layer against the water or oil based ink to be ejected. The cover material 15 is removed from areas corresponding to the common ink channel 11 and the ink chambers 13 by exposure and development. Afterward the remaining cover material is hardened to form the partition member 15. An approximately 50 μm thick PET film 14 is adhered to the partition 15 using ultraviolet hardening adhesive. A row of nozzles 2 are then dry etched into the PET film 14. The silicon wafer is then cut to a predetermined size and mounted to the head mounting frame 3 to form the completed head 100 shown in FIG. 2. It is preferable to remove photoresist and PET film where the silicon wafer is to be cut at the time of photoetching.

As shown in FIG. 4, an ink jet printer 200 of the present invention includes: the above-described print head 100 of FIGS. 2 and 3; and a head drive circuit 300 for driving the print head 100. The head drive circuit 300 includes a head drive power source 43, a signal generation circuit 44 for generating a binary print data signal and a clock signal, and a large scale integrated circuit (LSI) power source 45. The drive LSI circuit 12 in the print head 100 includes a shift register 41, a driver circuit 42 and a gate circuit 47 connecting the shift register 41 to the driver circuit 42. Wiring 19 for connecting the head drive circuit 300 to the print head 100 for serially driving the thermal resistors 16 in all the ink chambers 13 is constructed from only five lines: a data line 19*a*, a clock line 19*b*, a driver circuit power source line 19*c*, a LSI device power source line 19*d*, and a ground line 19*e*. The data line 19*a* is provided for serially sending the binary print data from the signal generation circuit 44 to the shift register 41. The clock line 19*b* is provided for transmitting the clock signal from the signal generation circuit 44 to the shift register 41. The driver circuit power source line 19*c* is provided for connecting the head drive power source 43 to the driver 42. The LSI device power source line 19*d* is provided for connecting the LSI power source 45 to the shift register 41. It is noted that the LSI drive circuit 12 has five pedestals or terminals 46*a* through 46*e* on one end of the silicon substrate 9, at which the five wires 19*a* through 19*e* are connected to the LSI drive circuit 12.

The ink jet printer 200 according to the first preferred embodiment uses a serial consecutive drive. Therefore the drive LSI circuit 12 requires no latch circuit as do drive LSI circuits of conventional printers which use block drive. In a conventional thermal ink jet printer, a latch circuit is provided between the shift register and the driver. A timing generation circuit must also be added to the head drive circuit for the latch circuit. Additionally, two or three lines of wiring must be added to transmit signals to the head. Contrarily, the printer according to the first preferred embodiment that is driven by serially consecutive drive and that has a head drive circuit 300 and a print head 100 as shown in FIG. 4 requires a smaller scale circuit, fewer lines of wiring in the head, and can be produced at lower costs when compared to conventional printers. In concrete terms, because only five signal wires for drive control are required per head, mounting costs of the head are reduced.

The following text will describe, in greater detail, the serially consecutive drive method employed in the present invention, while referring to FIGS. 4 and 5(*a*). It is noted that during this serial consecutive drive method, the head 100 and the print sheet 51 are moved relative to each other in an auxiliary scanning direction B approximately perpendicular to the main scanning direction A, that is, perpendicular to the row of nozzles 2 in the head 100. In this example, the head 100 is stationary and the print sheet 51 is transported continually at a set speed.

The signal generation circuit 44 (e.g., including a print data original series producing part and a print data series transforming part a, as described below) is controlled, by a CPU (not shown) provided in the head drive circuit 300, to serially and consecutively generate a series of binary print data $(A_{i,j})_{j=1 \text{ to } 2n}$ for producing each line (i-th line where i=1, 2, . . . ) extending in the main scanning direction A on the sheet 51. The series of print data $(A_{i,j})_{j=1 \text{ to } 2n}$ include 2n print data $A_{i,j}$ where j=1, 2, . . . , 2n. Each print data $A_{i,j}$ includes print information on each dot j of 2n dots to be printed on the corresponding i-th line, where 2n is the total number of the nozzles 2 formed in the print head 100. The series of binary data $(A_{i,j})_{j=1 \text{ to } 2n}$ are serially and consecutively transmitted to the shift register 41 via the data line 19*a*.

As shown in FIG. 4, the shift register 41 has 2n register elements aligned in the main scanning direction A. The gate circuit 47 has 2n gates aligned in the main scanning direction, and the driver 42 has 2n portions aligned in the main scanning direction. The 2n portions of the driver 42 serve to respectively drive the 2n thermal resistors 16 aligned in the main scanning direction A. Each register element (j-th register element) is connected via a corresponding gate (j-th gate) in the gate circuit 47 to a corresponding portion (j-th portion) of the driver 42. The j-th portion of the driver 42 is for driving a corresponding j-th thermal resistor 16 to print a j-th dot on the corresponding i-th line on the sheet 51.

The shift register 41 shifts the received print data $A_{i,j}$ from one register element to a next register element in the main scanning direction of FIG. 4, synchronously with the clock signals CL supplied to the shift register 41 from the signal generation circuit 44. Accordingly, at the time when a j-th clock signal $CL_j$ is inputted to the shift register 41, a j-th print data $A_{i,j}$ properly reaches a corresponding j-th register element.

The shift register 41 is constructed to output the print data to the gate circuit 47, synchronously with the received clock signals CL. The shift register 41 can therefore send out the print data, as located in the respective register elements at the time when the shift register 41 receives the clock signals CL, toward the corresponding gates in the gate circuit 47.

The gate circuit 47 is constructed so that each j-th gate is opened only at the time when the corresponding j-th clock signal $CL_j$ is supplied via the shift register 41 to the gate circuit 47. Accordingly, the gate circuit 47 can supply each j-th print data $A_{i,j}$ to the drive circuit 42 only at the time when the j-th print data $A_{i,j}$ is located in the corresponding j-th register element in the shift register 41. Thus, the gate circuit 47 can send out each j-th print data $A_{i,j}$ properly to the corresponding j-th portion of the driver 42. The j-th portion of the driver 42 therefore properly drives the j-th thermal resistor 16 to print the j-th dot, in accordance with the j-th print data $A_{i,j}$.

Because the shifting operation by the shift register 41 successively supplies the series of print data $A_{i,j}$ to the corresponding j-th shifting elements, the gate circuit 47 can successively supply the series of print data $A_{i,j}$ to the corresponding j-th portions of the driver 42 so as to successively drive the j-th thermal heaters 16.

Thus, the shift register 41 and the gate circuit 47 cooperate to serially output the series of print data $(A_{i,j})_{j=1 \text{ to } 2n}$ to the corresponding j-th portions of the driver 42, in synchronism with the clock signals. When the print data $A_{i,j}$ is an ejection signal (i.e., is 1), the corresponding j-th portion of the driver 42 applies a voltage at a predetermined pulse width to the corresponding j-th thermal resistor 16, thereby causing the thermal resistor 16 to heat. If print data $A_{i,j}$ is not an ejection signal (i.e., is 0), the voltage is not applied. When all dots j of one line i have been printed (i.e., $A_{i,j}$ for j=1 to 2n have all been processed), print drive continues for the next line i+1 (i.e., $A_{i+1,j}$ where j=1 to 2n). In more concrete terms, the signal generation circuit 44 serially outputs the next series of print data $(A_{i+1,j})_{j=1 \text{ to } 2n}$, and the shift register 41 and the gate circuit 47 cooperate to serially output the print data $(A_{i+1,j})_{j=1 \text{ to } 2n}$ to the corresponding thermal elements 16. When all the signals $A_{i,j}$ (j=1 to 2n) for one line i are 1 to drive all the nozzles 2 on the print head 100 to eject ink droplets 50, the pattern of ink droplets produced on the sheet 51 appears as shown in FIG. 5(*a*).

As described above, printing while feeding the print sheet at a continuous speed becomes possible with the present invention. Continuous-speed feed of the print sheet is better suited for high-speed printing and is also technically easier than is step feed.

The above-described structure of the present invention may be applied to a line head of full color ink jet printing.

Figure 7:
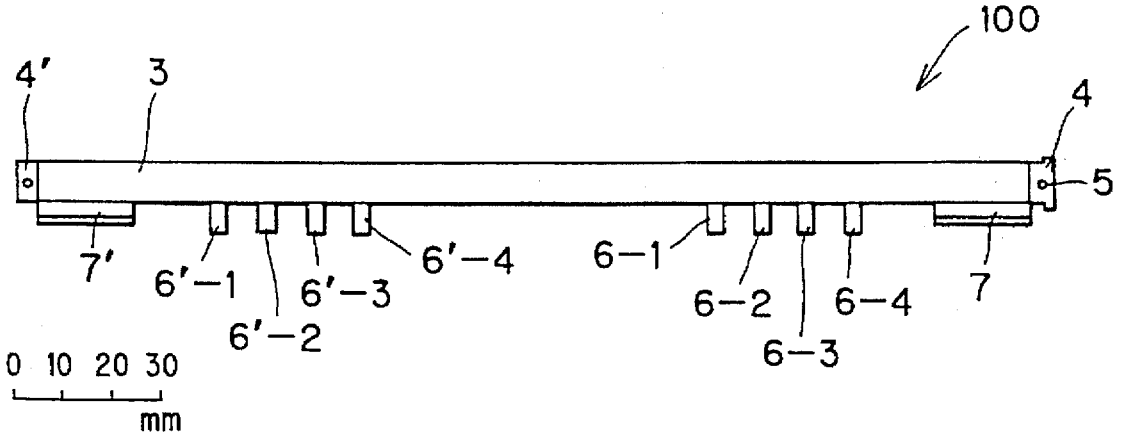
FIG. 7 is a side view showing the line head shown in FIG. 6.
Figure 8:
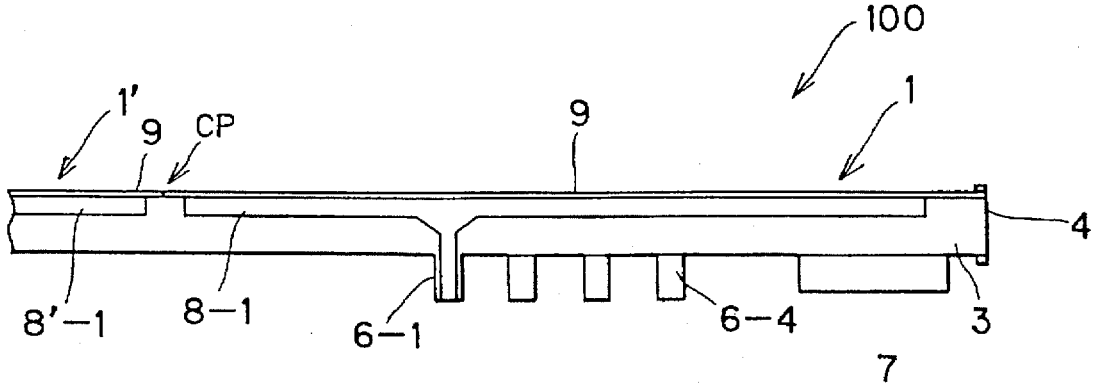
FIG. 8 is a side sectional view showing internal structure of the line head shown in FIG. 6 taken along a line VIII—VIII.
Figure 9:
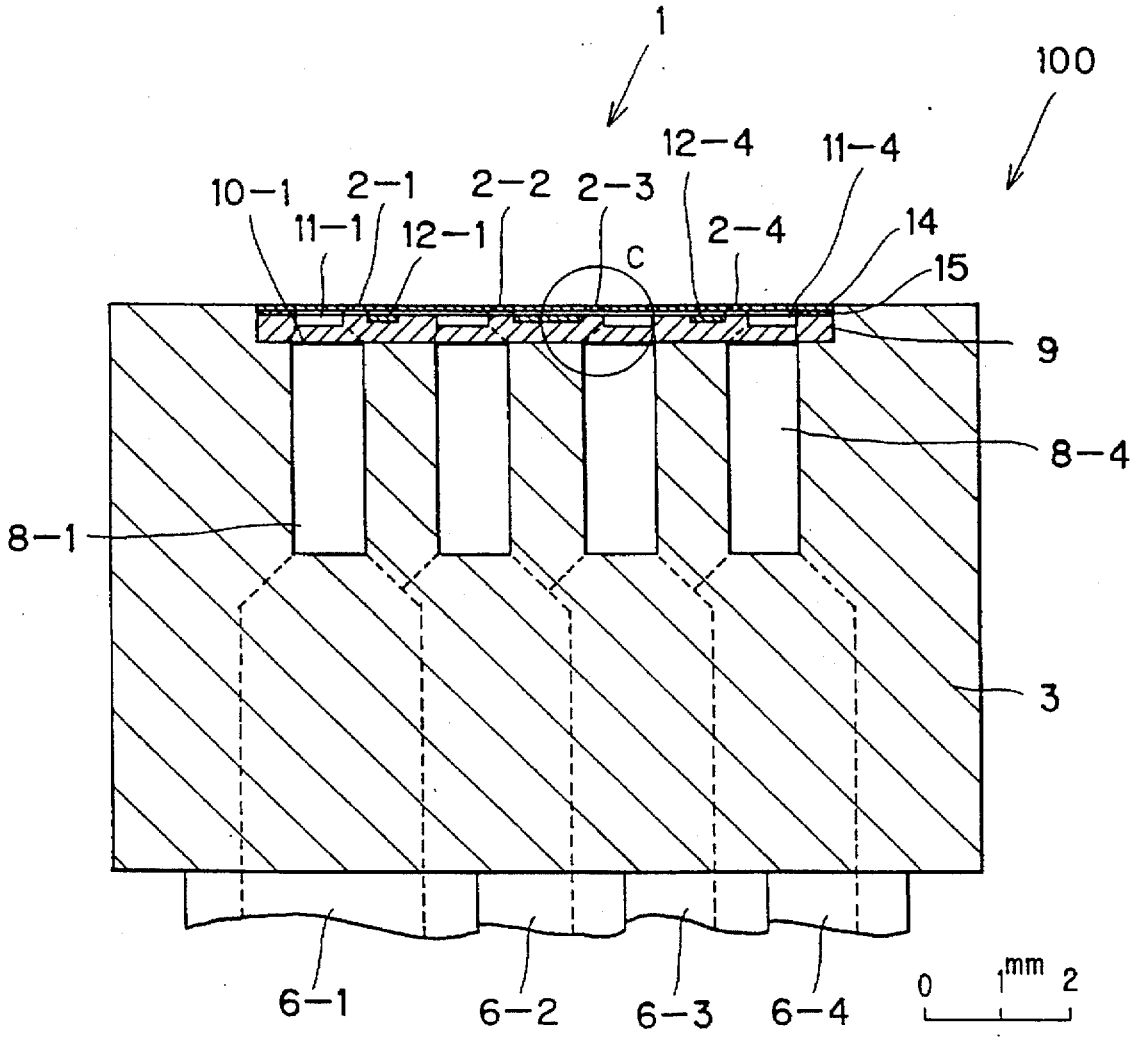
FIG. 9 is a cross-sectional view showing the line head shown in FIG. 6 taken along a line IX—IX.

The overall structure of the line head 100 in further detail will be described in the following text while referring to FIGS. 6 through 9. In order to produce the line head 100, as shown in FIG. 9, the monolithic drive portion 1 is formed with four rows of common ink channels 11-1, 11-2, 11-3 and 11-4 for black ink, yellow ink, cyan ink and magenta ink, respectively. Four sets of connection holes 10-1, 10-2, 10-3 and 10-4 are formed to fluidly connect with the common ink. Channels 11-1, 11-2, 11-3 and 11-4, respectively. Each set of the connection holes 10-1, 10-2, 10-3 and 10-4 includes a plurality of connection holes aligned intermittently in the main scanning direction A, in the same manner as the connection holes 11 of FIGS. 2 and 3.

Four rows of ink droplet generators are provided in connection with the common ink channels 11-1, 11-2, 11-3 and 11-4, respectively. Each row of the four rows of ink droplet generators includes a plurality of ink droplet generators aligned in the main scanning direction A. Similarly to the ink droplet generator shown in FIG. 2, each ink droplet generator includes an ink chamber 13, a thermal resistor 16 and conductors 17 and 18 connected to the thermal resistor 16, and a nozzle 2. Accordingly, four nozzle rows 2-1, 2-2, 2-3 and 2-4 are arranged in the auxiliary scanning direction B on a surface of the monolithic drive portion 1. Four sets of drive LSI circuits 12-1, 12-2, 12-3 and 12-4 are provided adjacent to the four rows of ink droplet generators. Each of the drive LSI circuits 12-1, 12-2, 12-3 and 12-4 is constructed as shown in FIG. 4 for performing the serial conductive drive.

As apparent from the above, the structure of the monolithic driving section 1 shown in FIG. 9 is substantially constructed from four monolithic driving sections 1 described with reference to FIGS. 2 and 3 that are arranged in the auxiliary scanning direction B. Accordingly, an enlarged view encircled in C in FIG. 9 is equivalent to the view of FIG. 2.

Figure 6:
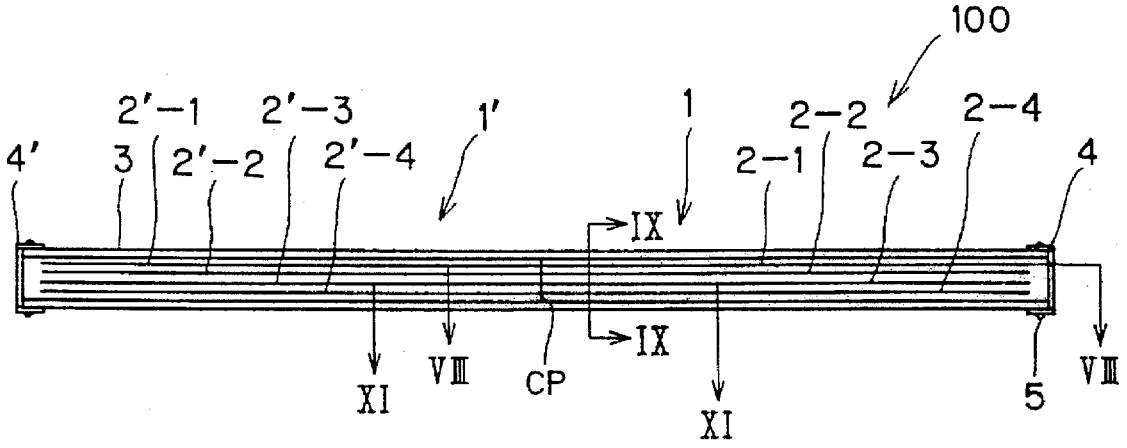
FIG. 6 is a top view showing a line head according to the present invention.

The above-described monolithic driving section 1 and another monolithic driving section 1' having the same structure of the monolithic driving section 1 are mounted on a single mount frame 3 so that each row of the four rows of nozzles 2-1, 2-2, 2-3 and 2-4 formed on the driving section 1 and each row of the four rows of nozzles 2'-1, 2'-2, 2'-3 and 2'-4 formed on the driving section 1' are arranged in line, as shown in FIG. 6.

As shown in FIG. 9, the mounting frame 3 is formed with a set of four ink supply channels 8-1, 8-2, 8-3 and 8-4 arranged in the auxiliary scanning direction B communicated with respective connection holes of the sets of connection holes 10-1, 10-2, 10-3 and 10-4 of the monolithic driving section 1. Therefore, a sufficient amount of ink from the ink supply channels 8-1 through 8-4 can be supplied to respective common ink channels 11-1 through 11-4 via respective connection holes 10-1 through 10-4. The mounting frame 3 is further formed with another set of four ink supply channels 8'-1, 8'-2, 8'-3 and 8'-4 arranged in the auxiliary scanning direction B communicated with the connection holes 10'-1, 10'-2, 10'-3 and 10'-4 of the monolithic driving section 1'. As shown in FIGS. 7 and 8, the mounting frame 3 is provided, at its reverse side, with one set of ink supply ports 6-1, 6-2, 6-3 and 6-4 for respectively supplying ink to the set of four ink supply channels 8-1, 8-2, 8-3 and 8-4. The mounting frame 3 is provided with another set of ink supply ports 6'-1, 6'-2, 6'-3 and 6'-4 for respectively supplying ink to the set of four ink supply channels 8'-1, 8'-2, 8'-3 and 8'-4. Therefore, the four colors of ink supplied from the ink supply ports 6 and 6' will not mix and a sufficient and necessary amount of ink can be supplied to each of the common ink channels 11-1 and 11'-1 through 11-4 and 11'-4.

A concrete example of the line head having the above-described structure will be given below.

The two monolithic driving sections 1 and 1' are mounted centered on the mounting frame 3 made from Fe-42Ni alloy using die bonding techniques. The monolithic driving sections 1 and 1' are connected at a connection portion CP. The two monolithic driving sections 1 and 1' are formed from equal approximately 107 mm by 8 mm sections of silicon wafers 9 and 9'. The two monolithic driving sections 1 and 1' therefore have a total 214 mm length L when connected. Two monolithic sections 1 and 1' are necessary because a maximum length of only 140 mm for a head can be produced from a single six inch wafer. The head mounting frame 3 is made from Fe-42Ni alloy because the expansion coefficient of Fe-42Ni alloy is substantially the same as that of silicon. A layer of nickel is provided to the entire surface of the print head by plating to give the print head good anti-corrosion properties.

As described above, four rows of nozzles 2 are provided in the line head: black nozzle row 2-1 and 2'-1, yellow nozzle row 2-2 and 2'-2, cyan nozzle row 2-3 and 2'-3, and magenta nozzle row 2-4 and 2'-4. Each row of nozzles on each monolithic driving section 1 (or 1') contains 1,512 nozzles. Because the two monolithic sections 1 and 1' are connected at the connection portion CP, the distance between the connection portion CP and the end nozzle nearest the connection portion CP limits the pitch and dot density of the line head 100. The line head of this example has the nozzles arranged with a pitch of 70 μm in the main scanning direction and therefore attains a dot density of 360 dots per inch (dpi). The line head 100 therefore contains a total of 3,024 nozzles for each color nozzle row which extends in a length of 210 mm.

It is noted that the monolithic sections 1 and 1' can be connected at a side edge rather than the tip edge CP to eliminate this limitation to the pitch of the nozzles. In this case the monolithic sections 1 and 1' would be shifted relative to each other in the widthwise direction by the width of the substrate sections 1 and 1' and then would be positioned so as to overlapped on an edge side.

As described already, according to the present invention, five wires 19 (shown in FIG. 2) are provided to transmit signals and power to the 1,512 ink droplet generators in each row of each of the monolithic driving sections 1 and 1'. Therefore, a total of twenty wires 19 are provided for all four rows of ink droplet generators of each driving section 1 or 1'. In this concrete example, the mounting frame 3 is provided, at its back side, with a pair of connectors 7 and 7' for supplying electric signals toward the drive LSI circuits 12-1, 12-2, 12-3 and 12-4 on the monolithic section 1 and 12'-1, 12'-2, 12'-3 and 12'-4 on the monolithic section 1, respectively. In the monolithic section 1, the drive LSI circuits 12-1, 12-2, 12-3 and 12-4 are formed with the total of twenty pedestals or terminals 46 on the silicon substrate 9 at its one end opposed to the connection portion CP. Similarly, in the monolithic section 1', the drive LSI circuits 12'-1, 12'-2, 12'-3 and 12'-4 are formed with the total of twenty pedestals or terminals 46' on the silicon substrate 9' at its one end opposed to the connection portion CP. The total of twenty wires 19 (or 19') are connected at one end to the twenty pedestals 46 (or 46') on the substrate 9 (or 9'), and are connected at other end to the connectors 7 (or 7). The twenty wires 19 (or 19') therefore serve to send the external control signal from the head driving circuit 300 received at the connectors 7 (or 7') to the twenty pedestals 46 (or 46') of the drive LSI circuits 1 (or 1'). The twenty wires 19 are held in a tape carrier (not shown), and the twenty wires 19' are held in another tape carrier (not shown). The two tape carriers 19 and 19' thus provided at opposite ends of the line head 100 are covered with press clasps 4 and 4' to be fixed to the opposite ends.

The 8 mm width of each of the monolithic sections 1 and 1' allows connecting the twenty wires 19 and 19' to the twenty pedestals provided at the end of the sections 1 and 1' at a density of about 3 lines/mm. Connecting lines at this density is easily performed with conventional mounting techniques. In comparison, using conventional techniques would require about 6,000 wire bonding processes to connect one half of the head. Additionally, nozzle rows would have to be bridged with connection lines which is technically impossible.

In the line head of this example, each of the drive LSI circuits 12-1, 12-2, 12-3 and 12-4 and 12'-1, 12'-2, 12'-3 and 12'-4 of the monolithic driving sections 1 and 1' is constructed as shown in FIG. 4 for performing the serial consecutive drive. All ink droplet generators in the line head 100 are caused to eject ink droplets to print 3,024 dots/line in 500 μs (2 kHz), for example. Therefore an entire A4 sheet can be printed in about two seconds or about 30 A4 size sheets per minute. The ejection frequency can be increased to a maximum of 5 KHz, thus allowing a print speed of 60 ppm (page per minute). Using the pump heaters described in copending U.S. patent application Ser. No. 068,348 is also an effective way to increase print speed. Details of the pump heaters is described in the application No. 068,348, the disclosure of which is hereby incorporated by reference.

If the width of the pulse of voltage applied to each thermal resistor is 1 μs, only six ink droplet generators or less are at some stage of having the 1 μs pulse applied to the thermal resistor 16 thereof at any one time (3,024 dots/500 μs=6 dots). When driving the head in this way, 0.5 W/dot is required for energizing each thermal resistor to eject each ink droplet. Therefore, the maximum energy that will need to be applied at any one time is less than three watts/line (i.e., 12 watts or less/line for full color print).

It is noted that when printing while driving the line head serially and consecutively, and feeding the sheet at a continuous speed as described above, each printed line on the sheet slants only one dot width, that is, a 60 to 70 μm shift per line at 360 dpi. The shift is only 30 to 40 μm with the print head 100 described in this concrete example because the line head 100 is constructed by two driving sections 1 and 1'. Slanting of printed rows formed during serial consecutive ejection of ink can be corrected by slanting the head itself the same amount as the slant of the printed rows. This can be done by producing the head substrate with a slanted arrangement. Although ink droplets will deform about 1 μm when impinged on the print sheet, this is insignificant compared to the 60 to 70 μm diameter of printed dots.

A line head as shown in FIGS. 6 through 9 was manufactured as per the above description, filled with ink and used to print an image by drive signals transmitted via the connectors 7 and 7'. The conditions of the drive are shown in the Table 1.

TABLE 1

| Aspect | Drive Condition |
|---|---|
| Applied pulse width | 1 μs |
| Applied power | 0.5 W/dot |
| Ejection frequency | 2 KHz |
| Dot scanning speed | 3 MHz × 2/color |
| Maximum number of dots driven simultaneously | 3 dots × 2 × 4/color |
| Maximum power consumption | 12 W or less |
| Print speed (for full color) | 2 sec/A4 |
| Sheet transport speed | 150 mm/sec (at continuous speed) |

The drive conditions shown in Table 1 are for when the monolithic driving sections 1 and 1' of the print head are driven separately. In this case, the serial continuous drive starts at the far left (as seen in FIG. 2) ink droplet generators of both the monolithic sections 1 and 1' and scans across the monolithic sections 1 and 1' separately at a scanning speed of 3 MHz. Alternately, the two driving sections 1 and 1' could be driven as a single driving section that is serially continuously driven at a scanning speed of 6 MHz from the far left hand ink droplet generator of monolithic section 1'. In this second method all drive conditions except the scanning speed are the same as shown in Table 1. The slant of printed rows will be an insignificant 60 to 70 μm.

Printing while feeding the print sheet at a continuous speed is possible with the present invention. Continuous-speed feed of the print sheet is better suited for high-speed printing and is also technically easier than is step feed. Even if the cycle for ejecting ink is only 2 kHz, an entire A4 size sheet can be printed in full color in about two seconds. Continuous-speed feed of the print sheet allows printing of high quality images inexpensively. A full color image printed at high speeds using this print head has an appearance equivalent to a full color photograph. A print head according to the present invention can also be produced for making B4 size full color images, with using a 6 inch silicon wafer.

Serially driving the head eliminates problems that can arise when the 3,024 thermal resistors per line are simultaneously or block driven, problems such as the capacity of thin films, especially of the common wiring conductors, being easily exceeded or the maximum power requirement of the head being excessively large. For example, the maximum power requirement could be reduced to ½ or ⅓. The drive circuit can also be simplified to thereby reduce production costs to about ⅔. The number of wiring operations can be decreased from the 88 to 1,513 wirings required in conventional print heads to only five.

Copending U.S. patent application Ser. No. 068,348 describes that the protection-layerless thermal resistor formed from the Cr—Si—SiO alloy thin film resistor 16 and nickel conductors 17 and 18 efficiently heats ink in the ink chamber when applied with an extremely short, i.e., 1 μs or less, pulse of voltage. The energy required to eject one droplet is 1/30th to 1/60 compared to conventional thermal resistors that have protection layers. Even when not considering the heat removed with ejected ink, the temperature of the head rises 1° C. or less per every A4 size sheet printed solid with four colors. Because so little energy is needed for printing with the print head according to the present invention, the amount of heat energy removed with ejected ink is relatively large. Therefore, the temperature of the print head rises 10° C. or less even when 100 sheets are printed consecutively in full color. By adding heat fins to the heat mounting frame 3, cooling or other temperature control becomes unnecessary even during continuous high-speed operation. Conventionally it has proven difficult to perform continuous high-speed print because most of the 30 to 60 times more energy required for driving conventional heads goes mainly to heating the head.

In the above-described full color line head 100, two monolithic driving sections 1 and 1' each having four rows of ink droplet generators are mounted on the mounting frame 3. However, such a full color line head can be produced by mounting, on the frame 3, two sets of four monolithic driving sections each having a single row of ink droplet generators and therefore having the structure shown in FIGS. 2 and 3. The two sets of monolithic driving sections are arranged on the frame 3 in the main scanning direction where each set having the four driving sections arranged in the auxiliary scanning direction. As a result, four rows of nozzles are obtained as shown in FIG. 6.

In a test, a line head 100 for full color print of A4 size sheets was produced from eight 2 mm wide monolithic driving sections for single color print, i.e., eight monolithic driving sections with only a single row of orifices. The precision of the external dimension when cutting the substrates 9 for each monolithic driving section from a silicon wafer was kept to within +/−3 μm through full dicing operation. Thus obtained eight single color monolithic driving sections arranged on the head mounting frame 3 and connected using die bonding techniques. It is noted that adhesive got in between the monolithic chips and error was generated in the distance between lines to produce a maximum variance of 20 μm between extreme positions in the line. By controlling the timing of ejections, the variance in position was sufficiently corrected to print an image with appearance substantially the same as that obtained from the four color line head 100 of the previously-described concrete example. The amount of correction depends on the amount of deviation caused during assembly and the timing of the line drive should be shifted by 7 μs for every variance. Adjustments for correction were performed using a test image for such adjustments.

The above description is directed to a fixed full color line head for printing on an A4 size sheet scanningly transported in the auxiliary scanning direction, to which is applied the print head of the present invention of FIGS. 2 and 3. The print head of the present invention of FIGS. 2 and 3 may also be applied to a scanning head scanningly movable in the main scanning direction across the width of a sheet. The scanning type head has the same structure as that of the line head except that it is formed so that its length is less than the width of a sheet to be printed on (an A4 size sheet, for example) and that it is mounted to a carriage movable in the main scanning direction. The above-described A4 length line head could be mounted to the carriage so as to be scanningly movable in the main scanning direction when an A3 size or larger sheet is to be printed on. Slanting of printed rows formed during serial consecutive ejection of ink can be corrected by slanting the main scanning direction of the print head.

As described above, the line head of the present invention can achieve an extremely rapid printing speed, i.e., a four color image on a sheet transported at a speed of 150 mm/sec with ejection frequency of 2 KHz. Accordingly, the line head of the present invention may preferably be combined with the drying means shown in FIG. 10. Thus combining the drying means to the line head can allow the printing liquid, or ink, impinged on the sheet to have sufficient time to dry during sheet transport. The printer device 200 provided with the combination of the drying means and the line head 100 can obtain an image with good appearance while maintaining the extremely rapid printing speed and preventing blurring of images.

Figure 10:
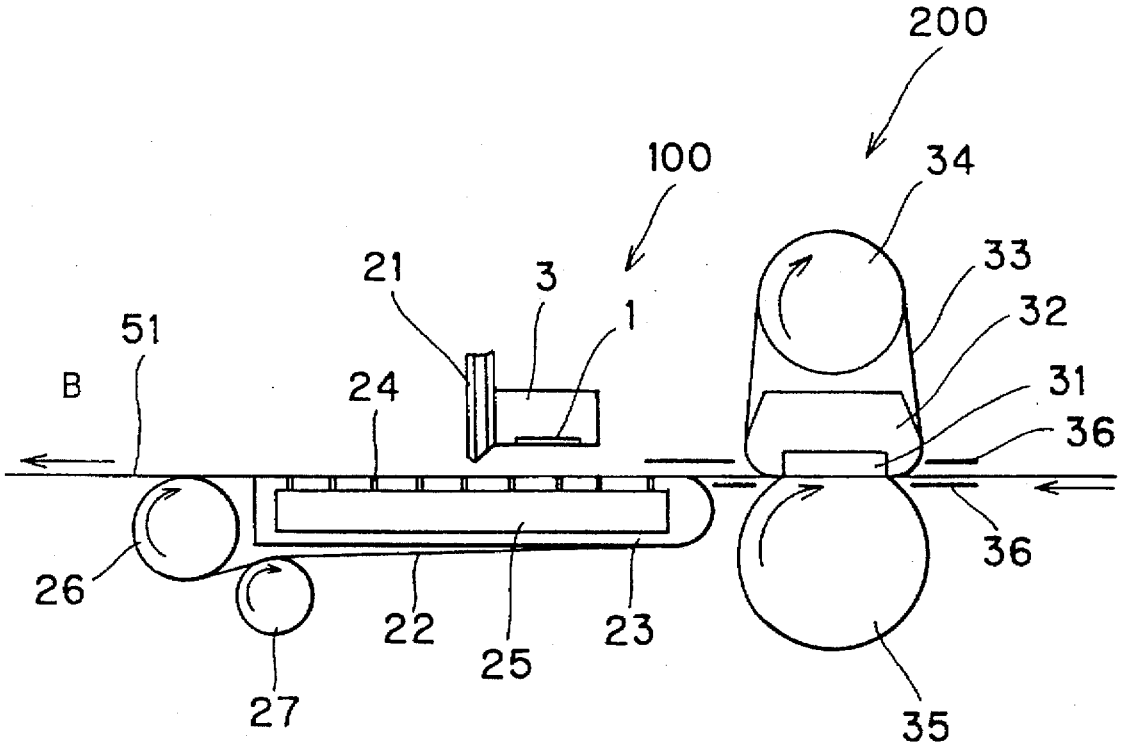
FIG. 10 is a schematic view of an ink jet printer employing a device for drying ink printed on a sheet and the line head shown in FIG. 6.

In FIG. 10, components numbered 31 through 36 constitutes a sheet heating device as described in Japanese Patent Application Kokai No. HEI 4-166966. In this sheet heating device, a PTC thermistor 31 with an auto-temperature control function and a Curie point of 150° C. is supported so as to confront a rotatably supported pressure roller 35. A sheet 51 to be printed is heated to a fixed temperature between 80° and 90° C. while being transported between the PTC thermistor 31 and the pressure roller 35 in an auxiliary scanning direction B on a level transport surface by the rotation of the pressure roller 35. Because the PTC thermistor 31 heats the sheet 51 to between 80° and 90° C., the Curie point of the PTC thermistor 31 is not exceeded. Heat efficiency is increased by the sheet 51 being pressingly transported by the pressure roller 35. Because the heat transport surface is level, even envelopes and the like can be transported and heated without being wrinkled.

A belt support 23 is supported adjacent to the sheet heating device. An uneven surface, with variation of about +/−100 μm between high and low areas, is provided to the surface of the belt support 23. An endless belt 22 is rotatably supported on the belt support 23 so that a portion of the endless belt 22 is aligned with the path of the sheet 51 as the sheet 51 exits from the sheet heating device in the transport direction. The belt support 23 is provided so as to rotate the endless belt 22 at a speed synchronized with speed of the sheet 51 as transported by the sheet heating device. A plurality of holes (not shown) about 0.5 mm in diameter are formed through the entire surface of the endless belt 22 at a pitch of 3 to 4 mm. A plurality of suction holes 24 are formed through the belt support 23 at almost the same pitch. A suction duct 25 is formed in the belt support 23 for fluidly connecting the suction holes 24 with a vacuum device (not shown). The line head 100 of the present invention shown in FIGS. 6 through 9 is supported to confront a sheet 51 transported on the endless belt 22. A suction nozzle 21 for producing a partial vacuum near the surface of a printed sheet 51 is supported at the side of the head 100 opposite the sheet heating device so as to confront the sheet 51 transported on the endless belt 22. A dry roller 26 is provided adjacent to the belt support 23 in the path of the sheet 51 as transported by the endless belt 22. To allow maintenance such as cleaning of the line head 100, the print sheet transport system (numbers 22 through 27) must be movable about 30 mm to the left but explanation of this will be omitted here.

A sheet 51 heated to 80° to 90° C. in the sheet heating device and discharged therefrom is taken up by the rotating endless belt 22. The sheet 51 is fixed to the endless belt 22 by the suction of the suction device as transmitted via the suction duct, the suction holes 24, and the holes formed in the endless belt 22. The uneven surface of the belt support 23 prevents the endless belt 22 from being overly strongly fixed to the belt support 23 by the suction from the suction duct 25. The preheated print sheet 28 is printed on by the ink jet print head 100 while being transported fixed to endless belt 22. The heat of the sheet 51 dries ink that impinges on the sheet 51 in about 0.3 to 0.4 seconds after printing. Evaporate from the drying ink is sucked up and exhausted via the suction nozzle 21 so it does not adhere to the head 1. Therefore, despite a print sheet of 150 mm/sec, an image printed on the sheet 51 can be handled as soon as it is discharged from the dry roller 26.

The above-described compact heating device is extremely fast and safe. Contrary to the above-described heating device which heats the sheet before the sheet is printed, conventional dryers for drying a printed sheet after it is printed require inclusion of a non-contact rapid heating device such as an infrared heater which is larger and not as safe.

As described above, according to the present invention, the monolithic driving section 1 is provided with a large number of nozzles 2 with high density. The drive LSI circuit 12 serially and consecutively drives the plurality of ink droplet generators so as to eject ink droplets from corresponding nozzles 2, as shown in FIG. 5(*a*). Each of the plurality of ink droplet generators ejects an ink droplet so that the ejected ink droplet may fly in a direction toward the sheet 51 at an ejection speed of V (about 10 m/s, for example). Thus ejected ink droplet has a spherical or slightly elongated shape in the flying direction. The ink droplet has a length or dimension L (40 to 50 μm, for example) in the flying direction. If the distance D between corresponding points, i.e., lead point and lead point or center and center, of ink droplets ejected from adjacent nozzles is substantially equal to or lower than the length L of the ink droplet, there is high possibility that the ink droplets may couple while flying toward the sheet 51, due to slight inaccuracies in their ejection or flying direction. Because these inaccuracies in the ejection direction become large after consecutive printing over a long period of time, the possibility of the ink-flight coupling increases after the consecutive long period printing operation. This ink-flight coupling may result in a decrease in quality of printed images.

According to the present invention, in order to prevent the ink droplets ejected from adjacent nozzles from coupling in flight, the shift register 41 may preferably be controlled to output the print data $A_{i,j}$ serially and consecutively to the drive circuit 42, with a phase difference T defined by an equation T=D/V having at least higher than L/V. That is, the phase difference T preferably satisfies an inequality T>L/V. The drive circuit 42 serially and consecutively drives the plurality of ink droplet generators with the phase difference T.

For example, when ink droplets have a spherical shape with a diameter L of about 40 to 50 μm and are ejected at V of about 10 m/s, the phase difference should be set at least higher than 4 to 5 μs to attain the distance D between corresponding points of ink droplets of greater than 40 to 50 μm. It is noted that ink droplets are usually slightly elongated in the flying direction to have a length L of about 100 μm, for example. Accordingly, the phase difference is preferably set to 10 μs or more which can obtain the distance D of 100 μm or more, to thereby largely reduce the possibility of the ink-flight coupling for the ink droplets. To completely eliminate the risk of ink-flight coupling even when ink droplets are greatly elongated in flight, the phase difference may preferably be increased to 30 to 50 μs.

In the concrete example of the ink jet print head 100 as shown in FIG. 6, ejected ink droplets have a spherical shape with a diameter of between 40 and 50 μm on average. If the distance between corresponding points, i.e., lead point and lead point or center and center, of ink droplets ejected from adjacent ink droplet generators is equal to or higher than about 40 to 50 μm, the possibility of the ink droplet coupling in flight increases. However, if the distance is lower than about 40 to 50 μm, the possibility decreases. It is noted that the ink droplets are usually slightly elongated in the flying direction to have length L of about between 100 μm to 130 μm. Accordingly, if the distance D is between 100 and 130 μm or more, the possibility of the ink droplets coupling in flight is reduced to near zero. In this concrete example, an ink droplet ejected from the head travels at a flight speed of about 13 m/sec. Thus, corresponding points of ink droplets ejected from adjacent ink droplet generators fired at a time phase difference of between 8 and 10 μs will be separated by about 100 to 130 μm. Accordingly, firings of adjacent ink droplet generators should preferably be adjusted between 8 and 10 μs or more. To completely eliminate the risk of ink-flight coupling, even when ink droplets are greatly elongated in flight, the time phase difference between firings of adjacent ink droplet generators can be increased to 30 to 50 μs. Consequently, quality of printed images will not drop even after consecutive printing over a long period of time. On the other hand, when the time phase difference between subsequent firings is less than 8 to 10 microseconds, quality of printed images can decrease due to in-flight coupling of droplets.

Accordingly, in the printer head 100 of this concrete example of the present invention, the ink droplet generators are preferably driven serially with a phase difference of 10 μs or more.

Alternatively, if it is necessary or desirable to serially drive the ink droplet generators to be driven with a phase difference of 10 μs or less, print data $A_{i,j}$ for driving the ink droplet generators are preferably restructured so as to cause adjacent ink droplet generators to be fired with a phase difference of 10 μs or more.

Below will be given a concrete example of a method for reconstructing the print data $A_{i,j}$ so as to prevent the ink-flight coupling of ink droplets at high print speed (that is, at a small phase difference of 10 μs or more, for example).

In this example, the alignment of print data ($A_{i,j}$) transmitted to the head, and also the clock signal for transmitting print data according thereto, are transformed or changed to prevent decreases in quality of printed images. Driving the head with the drive method according to this example will cause ink droplets to be ejected in the pattern shown in FIG. 5(*b*).

This drive method will be described in greater detail, below.

Assume that the signal generation circuit 44 of FIG. 4 is controlled, by the CPU provided in the head driving circuit 300, to supply the clock signals CL at frequency of f [Hz] to the shift register 41. (It is noted that the data generator 44 is also controlled to input the series of print data $A_{i,j}$ to the shift register 41 at the normal speed, i.e., frequency f.) In this case, the shift register 41 and the gate circuit 47 cooperate to serially or scanningly supply the series of print data $A_{i,j}$ to the corresponding ink droplet generators every 1/f [seconds]. Accordingly, the 2n ink droplet generators can be serially or scanningly fired every 1/f [seconds]. In other words, the time phase difference between firings of adjacent ink droplet generators is 1/f [seconds]. If $A_{i,j}$ for each line i are all 1, the ink droplets are ejected in the pattern as shown in FIG. 5(*a*) .

When the time phase difference 1/f between subsequent firings at adjacent ink droplet generators is small, for example, less than 8 to 10 μs, it becomes necessary to prevent ink-flight coupling of ink droplets. In this case, according to the present invention, the print data generator 44 is controlled by the CPU to change the frequency of the clock signals CL to be set at 2f [Hz]. The signal generation circuit (e.g., including a print data original series producing part and a print data series transforming part) 44 is further controlled by the CPU to transform one series of print data ($A_{i,j}$) where j=1 to 2n for each line i into two series of print data $(A_{i,2j-1}, 0)_{j=1 \text{ to } n}$ and $(0, A_{i,2j})_{j=1 \text{ to } n}$. The set of print data $(A_{i,2j-1}, 0)_{j=1 \text{ to } n}$ includes 2n print data $A_{i,1}$, 0, $A_{i,3}$, 0, $A_{i,5}$, 0, . . . $A_{i,2n-1}$, 0, and the other set of print data $(0, A_{i,2j})_{j=1 \text{ to } n}$ includes 2n print data 0, $A_{i,2}$, 0, $A_{i,4}$, 0, $A_{i,6}$, . . . 0, and $A_{i,2n}$ where each print data $A_{i,k}$ (k=1 to 2n) is 0 (no ejection) or 1 (ejection). The print data generator 44 is controlled by the CPU to transfer the set of print data $(0, A_{i,2j})_{j=1 \text{ to } n}$ immediately after completion of the transfer of the set of print data $(A_{i,2j-1}, 0)_{j=1 \text{ to } n}$.

The above-described print data transformation is represented by the following formula:

$(A_{i,j})_{j=1 \text{ to } 2n}=(A_{i,2j-1}, 0)_{j=1 \text{ to } n}+(0, A_{i,2j})_{j=1 \text{ to } n}$, where $(A_{i,2j-1}, 0)_{j=1 \text{ to } n}=A_{i,1}$, 0, $A_{i,3}$, $0A_{i,5}$, 0, . . . $A_{i,2j-1}$, 0, $(0, A_{i,2j})_{j=1 \text{ to } n}=0$, $A_{i,2}$, 0, $A_{i,4}$, 0, $A_{i,6}$, . . . 0, and $A_{i,2n}$.

To summarize, for every line i, 2n print data are divided between n number of odd and n number of even rows of data. Non-ejection data is inserted between each type of data to produce 2n number each of two print data rows. The shift register 41 and the gate circuit 47 are controlled to serially input the two series of print data $(A_{i,2j-1}, 0)_{j=1 \text{ to } n}$ and $(0, A_{i,2j})_{j=1 \text{ to } n}$ to the corresponding portions of the driver 42 at twice normal speed, i.e., frequency 2f, so that the number of the lines to be formed in the auxiliary scanning direction doubles. (It is noted that the data generator 44 is also controlled to input the two series of print data $(A_{i,2j-1}, 0)_{j=1 \text{ to } n}$ and $(0, A_{i,2j})_{j=1 \text{ to } n}$ to the shift register 41 at twice normal speed, i.e., frequency 2f.) Print data can easily be changed without increasing costs by using a portion of a signal process circuit, that is, the CPU provided in the head drive circuit 300. Doubling the clock frequency will not tax the capacity of the shift register 41 mounted to the head. Time to scan one line becomes n/f [seconds] and the ejection phase shift between adjacent ink droplets becomes:

$$1/2f+2n/2f=n/f.$$

For example, with a 64 nozzle/line serial scan type head provided with the structure shown in FIG. 2 operating under 640 KHz clock frequency to produce the droplet ejection pattern shown in FIG. 5(*a*), the phase shift between adjacent ink droplets becomes 1.56 microseconds ($1/64\times10^4$), thereby increasing the possibility of adjacent droplets coupling in flight. In contrast to this, the method resulting in the ink droplet pattern shown in FIG. 5(*b*) will result in a time phase difference between adjacent ink droplets of 50 μs ($1/2\times10^4$). The distance between droplets will therefore be 650 μm (13 m/sec×50 μs=650 μm), so that decreases in quality of the printed image can be completely prevented. The benefits of this method are even more striking with a large scale line head with 100 to 1,000 nozzles/line.

Rather than the drive method where every other droplet generator is driven, which will create the ink droplet pattern shown in FIG. 5(*b*), every third droplet generator can be driven. Other ejection methods can also be used as long as the time phase difference between ejections of adjacent droplet generators is 10 μs or more. Restructuring the drive signal to produce a phase shift of 20 microseconds or more is even more desirable.

A line head with 128 nozzles in a single row of the present invention was built including ink droplet generators formed as shown in FIG. 2. Every other line of a print sheet transported in front of the head was printed black by serially and Consecutively applying 1 μs pulses of voltage (1 W) to the thermal resistors of the ink droplet generators in the head. The quality of images printed at various ejection frequencies (in the range of 0.5 KHz to 5 KHz) and at various time phase differences between ejections of adjacent droplet generators (in the range of about 16 μs to about 1.6 μs). A drop in the quality of printed images was only occasionally observed when the phase shift was 7 to 8 microseconds or more and only observed after printing had been performed over a long period of time. On the other hand, quality of printed images quickly dropped when the time phase difference was shortened, even after cleaning the nozzle surface of the head.

On the other hand, when the print head was driven using the drive method described in the concrete example of the above-described method with an ejection frequency of 5 KHz, good quality of printed images was maintained even after consecutive printing was performed for a long period of time. The same good printing results were observed when every third droplet generator was driven or when printing was performed with a large scale line head.

It can therefore be understood that driving a thermal ink jet printer by the serial consecutive drive described above can completely prevent the type of drop in quality of printed images that can be generated when ink is ejected from nozzles aligned in a high density. Also this can be achieved without increasing production costs. The present invention can be applied to a wide variety of print heads such as a serial scan type head with a total of 64 droplet generators or a line head with a total of 3,024 droplet generators (1,512×2).

The above-described drive method applied to a print head with the structure shown in FIG. 2, that is, a top-shooting type ink jet print head where ink droplets are ejected in a direction perpendicular to the thermal resistor surface. However, the present invention can be used with a type of head where the ink droplets are ejected in a direction parallel to the surface of the thermal resistor and obtain the same effects.

The following text is an explanation of an print head according to a second preferred embodiment of the present invention. The pitch and dot density of the line head according to the first preferred embodiment are determined by the distance between the connection portion CP and the end nozzles in the monolithic sections 1 and 1' formed nearest the connection portion CP. Therefore, producing the connection portion CP becomes increasingly difficult the greater the dot density. It is an objective of the present embodiment to facilitate producing the connection portion CP of the line head.

Figure 11:
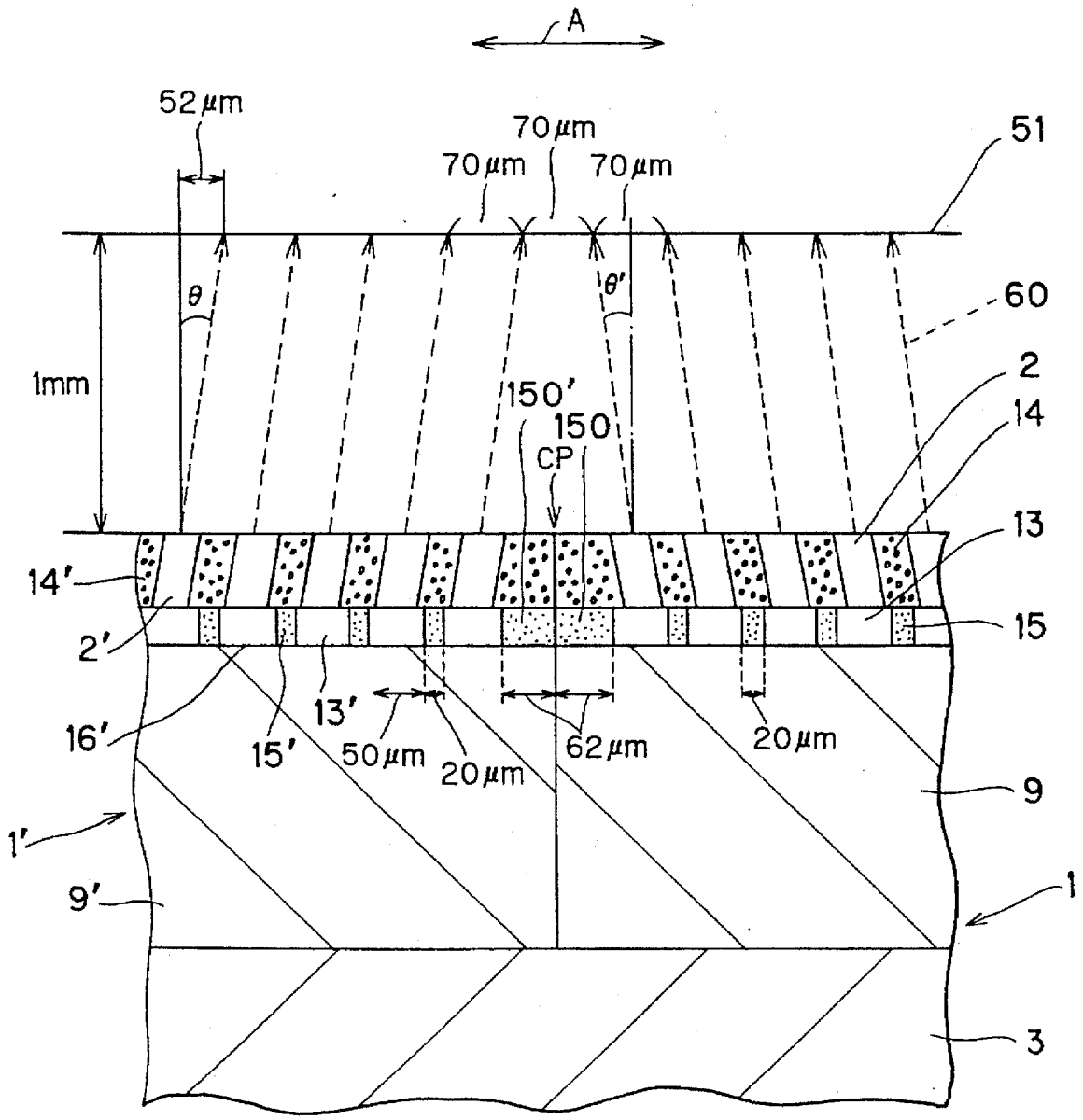
FIG. 11 is a cross sectional view of a line head of a second preferred embodiment of the invention which corresponds to the cross section of a line head of the first preferred embodiment taken along a line XI—XI of FIG. 6 and taken along a line XI—XI of FIG. 2.

As shown in FIG. 11, a line head according to the present embodiment is formed similarly to that of the first preferred embodiment, except that in the line head according to the present embodiment, angled nozzles 2 and 2' formed in nozzle plates 14 and 14' of monolithic sections 1 and 1' are angled slightly toward the connection portion CP' at an angle θ. The angle θ depends on the distance separating the nozzle plates 14 and 14' and the sheet 51 supported in front of the surface of the nozzle plates 14 and 14'. In a concrete example of the present embodiment, the nozzle plates 14 and 14' and the sheet 51 are separated by 1 mm, and therefore the angle θ is set at 3°. The angle θ of each angled nozzle is defined between a line following the axis of the angled nozzle and a line perpendicular to the surface of its respective nozzle plate. With this structure, even if the space between nozzles on either side of the connection portion CP is slightly greater than between other adjacent nozzles of the line head, the dot density of an image printed by the line head will be uniform. Forming the areas of the monolithic sections 1 and 1' near the connection portion CP, and aligning and assembling the monolithic sections 1 and 1' is easy.

The following is a description of a concrete example for producing a 369 dpi line head according to the present embodiment. This production method is similar to the concrete method described in the first preferred embodiment, except for production of the angled nozzles 2 and 2'. In the concrete example for producing the line head according to the present embodiment, a nozzle plate 14 is formed by first forming a film resist to a nickel plate to a thickness of 50 μm. Portions of the film resist are selectively exposed at an angle θ (for example, 3°) to form hardened column angled at the angle θ. The unexposed portions of the film resist are removed. Nickel is then plated to the nickel plate around the columns to a thickness of 40 to 45 μm. The resist columns are then removed to form the nozzles 2. The nickel plate is then lifted off, thereby forming the nozzle plate 14. In an alternative method, the nozzle plate 14 could be formed by exposing a light-sensitive glass, such as a PEG 3 glass ceramics produced by Hoya Corporation, at the angle θ. In this case, the nozzle plate 14 can be formed to 40 to 100 μm thickness. Next, another nozzle plate 14' is formed in the same manner by with angled nozzles 2' formed to an angle θ' equal but opposite to angle θ.

Partitions 15 and 15', and ink chambers 13 and 13', are then formed to substrates 9 and 9' respectively as described in the first preferred embodiment. The ink chambers 13 and 13' are formed with a width of 50 μm. To produce a dot density of 360 dpi, the partitions 15 and 15' are formed with a width of 20 μm. Connection areas 150 and 150', which will separate the monolithic sections 1 and 1' at the connection portion CP, are formed to a width of 62 μm. The nozzle plates 14 and 14' are attached to partitions 15 and 15' respectively, and the resultant monolithic sections 1 and 1' are connected together at their connection surfaces to produce the connection portion CP. The connected monolithic sections 1 and 1' are then mounted to a mounting frame 3.

Ink droplets ejected from the angled nozzles 2 and 2' will follow respective flight paths 60 to reach the sheet 51 that is positioned away from the surface of the nozzle plate 14 with a distance of 1 mm. As shown in FIG. 11, flight paths 60 follow lines aligned with the axes of the angled nozzles 2 and 2'. The angles θ and θ' of the angled nozzles 2 and 2' create a shift of 52 μm between the position where ink droplets impinge on the sheet 51 by following the flight paths 60 and where a line that intersects line aligned with the axis of the angled nozzle and that is perpendicular to the nozzle plate surface intersects the sheet. This 52 μm shift allows forming each of the connection areas 150 and 150'. to a width of 62 μm (52 μm+10 μm), which otherwise would need to be formed to a width of 10 μm to provide a uniform inter-nozzle distance of 20 μm. The wider connection areas 150 and 150' facilitate cutting the edges of the monolithic sections 1 and 1'. Also the wide connection areas 150 and 150' are more reliable against pressure fluctuations in respective ink chambers. Connection and mounting processes are also facilitated. Actually, it is preferable to produce the connection areas 150 and 150' to have a width of about 50 to 55 μm and not 62 μm to prevent invasion of adhesive from effecting the width. Because the connection areas 150 and 150' must be formed with a minimum width of 20 μm and because the angle θ should be determined dependently on the distance between the nozzle plate 14 and the sheet 51, the angle θ can be within the range 0.5 to 10° with 3° to 6° most preferable. However, an angle θ much larger than this makes producing the nozzle plate 14 difficult.

Although the head described in the present embodiment is a single color head with only one row of angle nozzles 2 and 2', the same technology could be used to produce an integrated color head with a plurality of rows as shown in FIGS. 6–9.

Although in the head described in the present embodiment the direction in which the ink is ejected is almost perpendicular to the thermal resistor surface, the ink ejection direction could be made parallel to the thermal resistor surface by using the same technology. In this case, compared to conventional technology where the ink chambers are provided at right angles to the surface of the nozzle plate, ink chambers are formed slanted at an appropriate angle of between 0.5 and 10°. The ink chambers are formed in the monolithic sections 1 and 1' so that when the monolithic sections 1 and 1' are joined together, their nozzles will slant in opposing directions. A head with this form can not be made into an integrated type head shown in FIG. 6 with a plurality of rows of nozzles in a single driving section, but several driving sections each with a single row of nozzles can be joined to form a full colorhead.

The following text is a description of a printer according to a third preferred embodiment of the present invention. Copending U.S. patent application Ser. No. 068,348 describes that a thermal resistor made from a Ta—Si—SiO alloy thin film and a nickel thin film has virtually the same properties as the thermal resistor made from a Cr—Si—SiO alloy thin film and a nickel thin film. Details of the Ta—Si—SiO alloy thin film are described in Japanese Patent Publication Kokai No. SHO-62-167056. A line head of FIG. 6 was made, but using thermal resistors made from a Ta—Si—SiO alloy thin film and a nickel thin film. The head was evaluated under the same conditions as shown in Table 1. A full color image with quality the same as that produced by the head described in the first preferred embodiment was obtained.

The following text is a description of a printer according to a fourth preferred embodiment of the present invention. Copending U.S. patent application Ser. No. 068,348 describes also that the good anti-corrosion and anti-cavitation properties of nickel make it a good conductor material to use in combination with a Cr—Si—SiO or a Ta—Si—SiO alloy thin film. However, there are limitations to producing nickel films. For example, a magnetron sputtering device with an especially strong magnetic field is necessary to produce a nickel film by sputtering because nickel has a strongly magnetic character. Also, nickel films require a separate process line from other semiconductor processes.

Copending U.S. patent application Ser. No. 068,348 also describes that tungsten also has excellent anti-corrosion properties. In a printer according to the present embodiment, tungsten is used as a conductor material in the thermal resistors of the ink droplet generators in combination with a Cr—Si—SiO or a Ta—Si—SiO alloy thin film. To test the suitability of tungsten as a conductor material in the thermal resistors, print heads were produced with thermal resistors including tungsten conductors in combination with a Cr—Si—SiO or a Ta—Si—SiO alloy thin film. The reliability of the thermal resistor was tested in water. The thermal resistor successfully underwent one billion continuous applications of voltage in pulses to show that a tungsten thin film has anti-cavitation properties equivalent to those of a nickel thin film. Although tungsten has anti-corrosion properties slightly inferior to nickel, it is non-magnetic, so can be produced using a normal magnetron sputtering device and in the same process line as other semiconductor processes. Tungsten also has a lower electric resistance than nickel.

As described above, the monolithic section 1 of FIG. 2 for an ink jet head 100 according to the present invention allow producing an extremely small head at low costs. A color print head 100 for printing color images can be produced by providing ink generators in more than one row in the head. It is preferable that ink droplet generators of the color print head be formed with top-shooting type ink droplet generators. Because the print head 100 is integratedly formed with driver LSI circuit 12 and the thermal resistors 16, connection between the head 100 and the external drive circuit 300 is possible even with a large number of ink generators. The serial consecutive drive of the print head is more effective than conventional block or matrix drive. Because the print head 100 is driven serially and consecutively, the LSI circuit 12 integrated in the print head 100 can be made without a latch circuit, and therefore can be made smaller, less expensively, and with higher yields. Because a plurality of connection holes 10 for connecting the common ink channel 11 with the ink supply channel 8 in the mounting frame 3 are formed in the substrate 9 to be aligned intermittently in the main scanning direction, the resultant substrate 9 has sufficient structural strength. If the connection holes 10 are connected together to extend in the main scanning direction, the resultant substrate 9 would be structurally weak and so could easily break apart.

Thus, according to the present invention, an ink jet print head having a plurality of nozzles in a high density and two dimensionally aligned to a large scale can be produced. The resultant head has a recording speed 10 to 100 times that of conventional ink jet recorders. The LSI circuit for driving the droplet generators in the head has only a shift register circuit and a driver circuit and requires only a total of five signal and power lines thereby decreasing costs. The present invention facilitates production of a line head compared to conventional technology. Continuous recording with the sheet transported at a uniform speed is possible, thereby facilitating transport of the sheet, reducing consumption of electricity, and negating any requirement for temperature control of the head. Because ink on the recorded sheet can be quickly dried, recording speed can be increased.

While the invention has been described in detail with reference to specific embodiments thereof, it would be apparent to those skilled in the art that various changes and modifications may be made therein without departing from the spirit of the invention.

For example, the present invention can be applied to a head for recording all types of images including, but not limited to, characters, graphics, and pictures.

The structure of the LSI circuit 12 is not limited to that as shown in FIG. 4. The LSI circuit 12 may have various structures for attaining the serial and consecutive drive method with no latch circuit provided between the shift register 41 and the driver circuit 42.

What is claimed is:

1. An ink jet print head, for ejecting ink droplets, comprising:

a monolithic silicon substrate including a top surface;

a plurality of ink chambers on the top surface of the silicon substrate, said plurality of ink chambers each comprising chamber walls, the plurality of ink chambers being aligned in a predetermined direction parallel to the top surface of the silicon substrate, each of the plurality of ink chambers being filled with ink, each chamber wall of said chamber walls including a nozzle portion, each nozzle portion including a nozzle and being located so that each nozzle is in fluid communication with a respective ink chamber of said plurality of ink chambers, a plurality of said nozzles being aligned in the predetermined direction;

an integrated circuit provided on the top surface of the silicon substrate and located adjacent to the plurality of ink chambers for outputting pulsed electric current; and a plurality of thermal resistors provided on the top surface of the silicon substrate, each of said plurality of thermal resistors being located in a corresponding ink chamber of the plurality of ink chambers, each of the plurality of thermal resistors including a thin-film conductor connected to the integrated circuit for receiving the pulsed electric current from the integrated circuit and a thin-film resistor connected to the thin-film conductor for receiving the pulsed electric current from the thin-film conductor and for generating pulsed heat in response to the pulsed electric current, the thin-film resistor including a surface portion exposed to the ink contained in the corresponding ink chamber for directly heating the ink with the pulsed heat so as to eject an ink droplet from the corresponding ink chamber through the nozzle, the thin-film resistor being made of a material selected from a group consisting of Ta—Si—SiO alloy and CrSi-SiO alloy, the thin-film conductor being made of a material selected from a group consisting of tungsten and nickel, wherein each of the plurality of thermal resistors directly heats the ink with the pulsed heat so as to eject an ink droplet from a corresponding nozzle of said plurality of nozzles at in ejection speed of V in a nozzle extending direction so that the ink droplet has a length of L in the nozzle extending direction, and wherein the integrated circuit includes driving means for selectively driving the plurality of thermal resistors serially and consecutively with a phase difference T between consecutive drives of the thermal resistors, the phase difference T satisfying an inequality $T>L/V$.

2. An ink jet print head of claim 1, wherein a plurality of monolithic silicon substrates are mounted on the mounting frame, each of the plurality of monolithic silicon substrates including a cover member including a row of nozzles comprising said plurality of nozzles, the plurality of silicon substrates being aligned on the mounting frame in the predetermined direction and the row of nozzles being aligned in the predetermined direction, wherein the cover member provided on each of the plurality of silicon substrates has a top cover surface and a lower cover surface opposing said top cover surface, wherein a thickness direction runs between said top cover surface and said lower cover surface and extends substantially perpendicular to the predetermined direction, the cover member including said row of the plurality of nozzles, each of the plurality of nozzles extending in a single second direction, said second direction being at a predetermined angle with respect to the thickness direction.

3. An ink jet print head of claim 2, wherein said predetermined angle comprises an angle within a range of 0.5 degrees to 10 degrees.

4. An ink jet print head of claim 2, wherein said predetermined angle comprises a value within a range of 3 degrees to 6 degrees.

5. An ink jet print head of claim 1, wherein the driving means includes a drive circuit for receiving a series of print data and for selectively supplying the pulsed electric currents to the plurality of thermal resistors serially and consecutively with the phase difference T between the consecutive supplies to the thermal resistors in response to the series of print data, to thereby drive the plurality of thermal resistors in response to the print data.

6. An ink jet print head of claim 5, wherein the integrated circuit further includes a shift register, connected to said drive circuit, for successively receiving said series of print data and for serially and consecutively outputting the series of print data directly to the drive circuit to thereby cause the drive circuit to serially and consecutively drive the plurality of thermal resistors in response to the series of print data.

7. An ink jet print head of claim 6, wherein the shift register serially and consecutively outputs the series of print data to the drive circuit with a phase difference T between print data in said series of print data so as to cause the drive circuit to serially and consecutively drive the plurality of thermal resistors with the phase difference T between consecutive drives of the thermal resistors, the phase difference T satisfying an inequality T>L/V.

8. An ink jet print head of claim 7, wherein the phase difference is 10 μs or greater.

9. An ink jet print head of claim 7, further comprising:

a print data original series producing means for producing an original series of print data, each of the original series of print data including one of an ON data for controlling the drive circuit to supply the pulsed electric current to a corresponding thermal resistor of said plurality of thermal resistors and an OFF data for controlling the drive circuit not to supply the pulsed electric current to a corresponding thermal resistor; and a print data series transforming means for transforming the original series of print data into at least two series of print data, each of the two series of print data having a plurality of print data arranged with each ON data being located between two OFF data, the print data series transforming part serially and consecutively outputting, to the shift register, the at least two series of print data, to thereby prevent ink droplets from being ejected consecutively from pairs of adjacent nozzles as arranged in the predetermined direction.

10. An ink jet printer, for ejecting ink droplets onto a sheet to thereby form a desired ink image on the sheet, comprising:

an ink jet print head for ejecting ink droplets, the ink jet print head including a mounting frame, said mounting frame including an ink supply channel and said ink jet print head further comprising a monolithic ink ejection section mounted on the mounting frame, the monolithic ink ejection section including:

a single silicon substrate including a top surface and a lower surface opposing said top surface, the silicon substrate being mounted on the mounting frame so that said lower surface contacts the mounting frame, the silicon substrate including a common ink channel extending in a predetermined direction along the top surface and a plurality of connection channels extending from the common ink channel to the lower surface, each of the plurality of connection channels including an opening in communication with the ink supply channel of the mounting frame, the plurality of connection channels being arranged in the predetermined direction with a gap being located between adjacent channels;

a plurality of ink chambers located on the silicon substrate, each ink channel including a partition member mounted on the top surface of the silicon substrate said plurality of ink chambers comprising a row of ink chambers, the row of ink chambers being arranged in the predetermined direction along the top surface of the silicon substrate, each of the plurality of ink chambers being filled with ink;

a plurality of nozzles each including a nozzle plate mounted on the partition member, said plurality of nozzles comprising a row of nozzles, said row of nozzles including an opening to said row of ink chambers for allowing fluid communication between the row of nozzles and the row of ink chambers, the row of nozzles extending in the predetermined direction;

an integrated circuit provided on the top surface of the silicon substrate for outputting pulsed electric current;

a plurality of thermal resistors provided on the top surface of the silicon substrate, each thermal resistor of said plurality of thermal resistors being located in a corresponding ink chamber of the plurality of ink chambers, each said thermal resistor including a thin-film conductor connected to the integrated circuit for receiving the pulsed electric current from the integrated circuit and a thin-film resistor connected to the thin-film conductor for receiving the pulsed electric current from the thin-film conductor and for generating pulsed heat, the thin-film resistor including a surface portion exposed to the ink for directly heating the ink with the pulsed heat so as to eject a droplet of ink through the nozzle, the thin-film resistor being made of material selected from a group consisting of Ta—Si—SiO alloy and Cr—Si—SiO alloy, the thin-film conductor being made of material selected from a group consisting of tungsten and nickel, wherein each of the plurality of thermal resistors of the ink jet print head directly heats the ink with the pulsed heat so as to eject an ink droplet from a corresponding nozzle of said plurality of nozzles at an ejection speed of V in a nozzle extending direction so that the ink droplet has a length of L in the nozzle extending direction, and wherein the integrated circuit includes means for selectively driving the plurality of thermal resistors serially and consecutively with a phase difference T between consecutive drives of the thermal resistors, the phase difference T satisfying an inequality T>L/V; and relative movement attaining means opposing said row of nozzles for supporting a sheet having a width extending in the predetermined direction and for attaining relative movement between the sheet and the ink jet print head in a second direction substantially perpendicular to the predetermined direction.

11. An ink jet printer as claimed in claim 10, wherein the relative movement attaining means continuously transports the sheet at a fixed speed along a transport path extending in the second direction, and wherein the integrated circuit includes:

a shift register for successively receiving a series of print data and including means for serially and consecutively outputting the series of print data; and a drive circuit, connected to said shift register and said plurality of thermal resistors, for receiving the series of print data from the shift register and for selectively supplying the pulsed electric current to a thermal resistor of wherein said means for serially and consecutively outputting causes the drive circuit to serially and consecutively drive the plurality of thermal resistors.

12. An ink jet printer as claimed in claim 11, wherein the shift register serially and consecutively outputs the series of print data to the drive circuit with a phase difference T between print data in said series of print data so as to cause the drive circuit to serially and consecutively drive the plurality of thermal resistors with the phase difference T between consecutive drives of the thermal resistors, the phase difference T satisfying an inequality T>L/V.

13. An ink jet print head of claim 11, further comprising an ink jet print head controller for controlling the ink jet print head, the ink jet print head controller comprising:

a print data original series producing means for producing an original series of print data, each of the original series of print data including one of an ON data for controlling the drive circuit to supply the pulsed electric current to a corresponding thermal resistor and an OFF data for controlling the drive circuit not to supply the pulsed electric current to a corresponding thermal resistor; and a print data series transforming means for transforming the original series of print data into at least two series of print data, each of the two series of print data having the plurality of print data arranged with each ON data being located between two OFF data, the print data series transforming part serially and consecutively outputting, to the shift register, the at least two series of print data, to thereby prevent ink droplets from being ejected consecutively from pairs of adjacent nozzles as arranged in the predetermined direction.

14. An ink jet prim head comprising:

a first monolithic section having a length extending in a lengthwise direction and a width extending in a widthwise direction, the lengthwise direction being substantially perpendicular to the widthwise direction, the first monolithic section including a first end surface provided at a lengthwise end of said first monolithic section and a nozzle surface;

a second monolithic section having a length extending in the lengthwise direction and a width extending in the widthwise direction, the second monolithic section including a second end surface provided at a lengthwise end of said second monolithic section and said nozzle surface, wherein the first end surface of the first monolithic section is connected to the second end surface of the second monolithic section, wherein the first monolithic section and the second monolithic section are arranged so that the nozzle surface of the first monolithic section and the nozzle surface of the second monolithic section are both aligned with a nozzle surface plane; and said ink jet print head further comprising a plurality of ink droplet generators for ejecting ink droplets, the plurality of ink droplet generators being located in the first monolithic section and the second monolithic section so as to be aligned in the lengthwise direction, each of said plurality of ink droplet generators including an ink chamber comprising an ink chamber wall, a thermal resistor located on the ink chamber wall in the ink chamber, and a nozzle comprising a nozzle wall, the nozzle wall being located so that the nozzle is positioned at a single predetermined angle with respect to the nozzle surface plane, other than perpendicular to the nozzle surface plane.

15. An ink jet print head of claim 14, wherein said nozzle is positioned at a predetermined angle such that said ink droplets are ejected outward from said nozzle surface and toward a line extending outward from a connection between said first end surface and said second end surface.

16. An ink jet print head according to claim 14, wherein said predetermined angle comprises an angles within a range of 0.5 degrees to 10 degrees from a line perpendicular to said nozzle surface plane.

17. An ink jet print head according to claims 14, wherein said predetermined angle comprises an angle within a range of 3 degrees to 6 degrees from a line perpendicular to said nozzle surface plane.

18. A printer comprising:

a print head including a monolithic section, the monolithic section including an exposed surface;

a plurality of ink droplet generators for ejecting ink droplets at a velocity in an ejection direction so that the ink droplets have an average length extending in the ejection direction, each ink droplet generator including an ink chamber comprising an ink chamber wall, a thermal resistor located on the ink chamber wall within the ink chamber, and a nozzle comprising a nozzle wall, the nozzle wall being connected to the ink chamber wall and the exposed surface, the plurality of ink droplet generators being included in the monolithic section so that a plurality of the nozzles are aligned in a predetermined order along the exposed surface;

a drive circuit for producing a serial drive signal for driving the plurality of ink droplet generators, the serial drive signal being produced so as to cause pulses of voltage to be selectively applied to a plurality of the thermal resistors of the ink droplet generators such that ejections of adjacent ink droplet generators have a time phase therebetween, wherein the time phase is greater than a quotient of the average length of the ink droplets divided by the velocity of the ink droplets.

19. A printer as claimed in claim 18 wherein the drive circuit comprises a signal generator for generating a signal with data in a data order corresponding to the predetermined order of the adjacent ink droplet generators, and signal restructuring means for restructuring the signal so that adjacent ink droplet generators are not consecutively driven.

20. A printer comprising:

a print head including a monolithic section, the monolithic section including an exposed surface;

a plurality of ink droplet generators for ejecting ink droplets at a velocity in an ejection direction so that the ink droplets have an average length extending in the ejection direction, each ink droplet generator including an ink chamber comprising an ink chamber wall, a thermal resistor located on the ink chamber wall within the ink chamber, and a nozzle comprising a nozzle wall, the nozzle wall being connected to the ink chamber wall and the exposed surface, the plurality of ink droplet generators being included in the monolithic section so that a plurality of the nozzles are aligned in a predetermined order along the exposed surface;

a drive circuit for producing a serial drive signal for driving the plurality of ink droplet generators, the serial drive signal being produced so as to cause pulses of voltage to be selectively applied to a plurality of the thermal resistors of the ink droplet generators, the drive circuit including a signal generator, for generating a signal with data in a data order corresponding to the predetermined order of the ink droplet generators, and signal restructuring means, for restructuring the signal so that adjacent ink droplet generators are not consecutively driven, whereby ejections of adjacent ink droplet generators have a time phase therebetween, the time phase being greater than a quotient of the average length of the ink droplets divided by the velocity of the ink droplets.

* * * * *